US005477218A

United States Patent [19]

Manmoto et al.

[11] Patent Number: 5,477,218

[45] Date of Patent: Dec. 19, 1995

[54] SMOKE DETECTING APPARATUS CAPABLE OF DETECTING BOTH SMOKE FINE PARTICLES

[75] Inventors: Atsushi Manmoto, Machida; Yukio Yamauchi, Atsugi, both of Japan

[73] Assignee: Hochiki Kabushiki Kaisha, Tokyo, Japan

[21] Appl. No.: 173,628

[22] Filed: Dec. 23, 1993

[30] Foreign Application Priority Data

| | | | |
|---|---|---|---|
| Jan. 7, 1993 | [JP] | Japan | 5-000982 |
| Jan. 7, 1993 | [JP] | Japan | 000984 |
| Oct. 7, 1993 | [JP] | Japan | 5-251281 |
| Oct. 7, 1993 | [JP] | Japan | 5-251283 |

[51] Int. Cl.[6] ..... G08B 17/10

[52] U.S. Cl. ..... 340/630; 340/628; 340/629; 250/574; 356/43

[58] Field of Search ..... 340/628, 629, 340/630; 250/574, 485.1; 356/43, 51

[56] References Cited

U.S. PATENT DOCUMENTS

| | | | |
|---|---|---|---|
| 4,225,791 | 9/1980 | Kompelien | 250/574 |
| 4,260,984 | 4/1981 | Honma | 340/630 |
| 4,405,919 | 9/1983 | Scheidweiller | 340/630 X |
| 4,506,161 | 3/1985 | Muggli et al. | 250/574 |
| 4,556,873 | 12/1985 | Yamada et al. | 250/574 X |
| 4,638,304 | 1/1987 | Kimura et al. | 340/630 X |
| 4,647,789 | 3/1987 | Güttinger et al. | 250/574 |
| 4,665,311 | 5/1987 | Cole | 250/574 X |
| 4,670,741 | 6/1987 | Cole | 340/630 |
| 4,692,750 | 9/1987 | Murakami et al. | 340/630 X |
| 4,755,048 | 7/1988 | Kaufman | 250/574 X |
| 4,757,306 | 7/1988 | Kimura | 250/574 X |
| 4,785,283 | 11/1988 | Yuchi | 340/630 X |
| 4,827,247 | 5/1989 | Giffone | 250/574 X |
| 4,839,527 | 6/1989 | Leitch | 340/630 X |
| 5,172,004 | 12/1992 | Furuya | 250/574 X |

*Primary Examiner*—John K. Peng
*Assistant Examiner*—Edward Lefkowitz
*Attorney, Agent, or Firm*—Max Fogiel

[57] ABSTRACT

A light emitting device for projecting a light beam onto a monitor area, and a light receiving device, arranged so that a light beam is not directly received by the device, for receiving diffused light caused as a result of fine particles, such as dust, or smoke caused by a fire, entering the monitor area, are provided. Also, an amplifying device for amplifying an output from the light receiving device, and a counting device for counting the output from the amplifying device in units of time are provided. In addition, a computing device for computing an average value or an integrated value of the output from the amplifying device in units of time, and a determining device for determining the level of contamination of the monitor area on the basis of the count value of the counting device and for determining the level of the fire on the basis of the average value or the integrated value computed by the computing device, are provided. As a result, a smoke detecting apparatus consisting of a single unit capable of detecting both smoke and fine particles can be provided, the apparatus detecting a fire on the basis of an environmental abnormality.

30 Claims, 27 Drawing Sheets

SMOKE DETECTING APPARATUS CAPABLE OF DETECTING BOTH SMOKE FINE PARTICLES

BACKGROUND OF THE INVENTION

1. Field of the Invention

The present invention relates to a smoke detecting apparatus and, more particularly, to a smoke detecting apparatus capable of detecting both smoke and fine particles such as dust.

2. Description of the Related Art

Hitherto, as a smoke detecting apparatus for detecting smoke caused by a fire, and a circuit therefor, a photoelectric analog smoke sensor disclosed in Japanese Patent Laid-Open No. 63-32690, and a smoke detector and a photoelectric smoke detecting circuit disclosed in U.S. Pat. Nos. 4,166,960 and 4,654,644, have been known.

In this photoelectric analog smoke sensor, a light emitting chamber and a light receiving chamber are disposed in a chamber which is formed into a labyrinth. The light receiving chamber is placed at a position where light emission from the light emitting chamber is not directly received, so that diffused light caused by smoke entering the chamber is detected by the light receiving chamber, and a signal corresponding to the smoke density is obtained on the basis of the amount of received light in the light receiving chamber.

In the photoelectric analog smoke sensor, a light-emission drive circuit for making light emitting elements such as LEDs emit light intermittently is disposed in the light emitting chamber, and a light-receiving signal amplifying circuit provided with a light receiving element, such as a photodiode, is disposed in the light receiving chamber.

When diffused light caused by smoke in the chamber is detected by a light receiving element, a signal at a level corresponding to the smoke density is photoelectrically converted by the photodiode in the above-mentioned light-receiving signal amplifying circuit and then amplified. The output from this light-receiving signal amplifying circuit is integrated by an integrating circuit and then amplified by a DC amplifying circuit. In this way, a conventional smoke detector obtains an analog signal having output characteristics required by an automatic fire notification system.

However, in such a conventional photoelectric analog smoke sensor, the integrated amount of diffused light is detected. Therefore, the integrated amount is small in an area where the volume of fine particles caused by a fire is small. As a result, it is not possible to detect very small amount of smoke generated in the initial period of a fire.

On the other hand, since fine particles such as dust cannot be detected by the conventional photoelectric analog smoke sensor, it is not possible to distinguish dust and water vapor from smoke, nor to distinguish environmental abnormalities such as the contamination of the inside of the chamber at the same time smoke is detected. Hitherto, examples for detecting fine particles are an indoor environment monitoring system disclosed in Japanese Patent Laid-Open No. 2-254340; a fine particles sensor disclosed in U.S. Pat. No. 4,226,533; a sampling apparatus for analyzing gases contaminated with much dust disclosed in U.S. Pat. No. 4,459,025, and the like. Another example for preventing erroneous notification caused by fine particles such as dust, is a particle-size measuring type smoke detector disclosed in Japanese Patent Laid-Open No. 2-300647.

Accordingly, in particularly a clean room, a fine particles detecting sensor is disposed to monitor dust first. Along with this sensor, a detector such as the above-described photoelectric analog smoke sensor is disposed to prevent an accident due to fire. In this case, the cost of the fine particles detecting sensor is high. Therefore, there has been a demand to develop an apparatus capable of detecting environmental abnormalities at low cost. The application of the particle-size measuring type smoke detector may be considered. However, this detector is incapable of detecting fine particles of 1 μm or less, and the detector is very expensive.

SUMMARY OF THE INVENTION

The present invention has been achieved in view of the above-described problems of the prior art. It is an object of the present invention to provide a smoke detecting apparatus consisting of a single unit capable of detecting both smoke and fine particles, which detects fires on the basis of the detection of environmental abnormalities.

It is another object of the present invention to provide a smoke detecting apparatus capable of detecting both smoke and fine particles, such that when fine particles are detected it can distinguish whether the fine particles are vapor or dust, making it possible to output a fire warning alarm when the fine particles are smoke and to output a contamination alarm when the fine particles are vapor.

To achieve the above-described objects, as shown in FIGS. 1 and 2, according to a first aspect of the present invention, there is provided a smoke detecting apparatus capable of detecting both smoke and fine particles, comprising: light emitting means for projecting a light beam onto a monitor area; light receiving means, disposed at a position where a light beam projected from the light emitting means is not directly received, for receiving diffused light caused by fine particles, such as dust, or smoke, caused by fire entering the monitor area; amplifying means for amplifying the output from the light receiving means; counting means for counting the number of times that the output from the amplifying means has exceeded a predetermined level in units of time, for the purpose of detecting the fine particles; computing means for computing the average value or the integrated value of the output from the amplifying means in units of time in order to detect the smoke; and determining means for determining the contamination level of the monitor area on the basis of the count value counted by the counting means and determining the occurrence of a fire or the stage of the fire on the basis of the average value or the integrated value determined by the computing means.

According to the smoke detecting apparatus capable of detecting both smoke and fine particles, constructed as described above in accordance with the present invention, since the received light output is counted in units of time for the purpose of detecting fine particles, it is possible to detect the density of very small amounts of smoke generated in the initial period of a fire and to issue a fire warning alarm. Since the level of contamination of the air can be determined by detecting the fine particles, it is possible to determine environmental abnormalities. In addition, since there is no need to provide a conventional fine particle detecting sensor and only one apparatus is required to detect both fine particles and smoke caused by a fire, costs can be reduced. Further, since the density of the smoke is detected to determine an integrated value or an average value of diffused light when the density of the smoke is high, it is possible to reliably determine the level of the fire and to signal the occurrence of a fire.

To achieve the above-described objects, according to a second aspect of the present invention, there is provided a smoke detecting apparatus capable of detecting both smoke and fine particles, comprising: light emitting means for projecting a light beam onto a monitor area; light receiving means, disposed at a position where a light beam projected from the light emitting means is not directly received, for receiving diffused light caused by fine particles, such as dust, or smoke caused by fire entering the monitor area; amplifying means for amplifying the output from the light receiving means; frequency computing means for differentiating the output from the amplifying means for each predetermined level and computing the frequency distribution of the appearance of the output of the level for each level; storing means for prestoring the frequency distribution of the output of the light receiving means for each output level when smoke particles enter the monitor area, and for prestoring the frequency distribution for each output level when other fine particles enter the monitor area; and determining means for comparing the frequency distribution computed by the frequency computing means with that stored in the storing means and distinguishing between smoke or other fine particles.

According to the smoke detecting apparatus capable of detecting both smoke and fine particles, constructed as described above in accordance with the present invention, the frequency distribution of the output level of fine particles, and the frequency distribution of the output level of other fine particles, such as dust or vapor, are prestored, so that the frequency distribution of the output level of the fine particles, obtained by computing by the frequency computing means is compared with each stored frequency distribution. Therefore, it is possible to determine whether the detected fine particles are smoke, dust or vapor. When it is dust, the particle size is larger than that of smoke, and the frequency distribution of the output level for each level becomes a substantially normalized distribution. On the other hand, when the detected fine particles are smoke, since the particle size is small in the initial state, the frequency distribution of the output level for each level becomes a rightward-descending frequency distribution which is characteristic of smoke. Therefore, the comparison of the frequency distribution obtained by computing by the frequency computing means with each prestored frequency distribution of smoke or the like makes it possible to determine whether the detected fine particles are smoke or dust in the initial stage. When the detected fine particles are determined to be smoke, a fire warning alarm is issued. When they are determined to be dust or the like, it is possible to issue a contamination alarm. When the detected fine particles are determined to be smoke and the smoke density is increased thereafter in the initial stage, the fire determination level may be lowered.

According to the present invention, the light emitting means is preferably formed of a halogen lamp or a laser diode.

According to the present invention, the first light emitting means is provided with pulse-light/continuous-light switching means for switching a signal output to the drive means for driving the light emitting means so that continuous light or pulse light is emitted from the light emitting means.

According to the present invention, a chopper is disposed on the front side of the light emitting means so that continuous light or pulse light is emitted from the light emitting means, and pulse-light/continuous-light switching means for switching a signal output to the drive means for driving the chopper is provided.

According to the present invention, a pump for supplying air of the space to be monitored to the monitor area and flowrate detecting means for detecting the flow rate of air in the monitor area are provided. In this case, the flow-rate detecting means is preferably a flow meter, a flow velocity meter, or a pressure gauge. The pump may be controlled on the basis of a value detected by the flow-rate detecting means so that the amount of air supplied to the monitor area can be maintained to be a constant amount, an output of the light receiving means being updated on the basis of the value detected by the flow-rate detecting means.

In the present invention, the monitor area is cleaned at predetermined time intervals. At these times, the cleaning is performed by supplying clean air to the monitor area. Also, fine particles in the monitor area may be detected even after the monitor area is cleaned.

In the present invention, the time during which parts are used may be recorded so that an alarm for demanding that the parts be replaced at predetermined time intervals is issued. At these times, the parts may be a pump or light emitting means.

In addition, in the present invention, when the amount of light emitted by the light emitting means or light receiving sensitivity of the first light receiving means is varied due to its deterioration or contamination, the amount of the light emission of the light emitting means or the light receiving sensitivity of the light receiving means may be corrected. In this case, an alarm may be issued. Preferably, a second light receiving means is disposed in the vicinity of the light emitting means so that when the amount of light received by the second light receiving means varies, the output of the light emitting means may be corrected, or when the amount of light received of the second light receiving means falls below a predetermined value, an alarm may be output, and a value of current consumption of the light emitting means is detected so that an alarm is issued when the current value falls below a predetermined value. As mentioned above, the second light receiving may be disposed in the vicinity of the light emitting means, and a third light receiving means may be disposed at a position where it faces the light emitting means, a light beam from the first light emitting means directly entering the third light receiving means, so that the amount of light received by the second light receiving means is compared with the amount of light received by the third light receiving means, an alarm being issued when the difference between them is a predetermined value or more. Alternatively, the second light receiving means may be disposed at a position where a light beam is directly projected onto the light receiving means, with the result that a test beam of a fixed amount is projected from the second light emitting means, so that the amount of the test beam is detected to correct the sensitivity of the second light receiving means. A second light emitting means may be disposed at a position where a light beam is projected directly onto the light receiving means, with the result that the amount of the received test beam is detected to correct the sensitivity of the light receiving means, or the test beam of the fixed amount is projected from the second light emitting means, an alarm being issued when the test beam of the fixed amount is a predetermined value or less.

The above and further objects, aspects and novel features of the invention will more fully appear from the following detailed description when the same is read in connection with the accompanying drawings. It is to be expressly understood, however, that the drawings are for the purpose of illustration only and are not intended to limit the definition of the invention.

DESCRIPTION OF THE PREFERRED EMBODIMENTS

Preferred embodiments of the present invention will be explained below with reference to the accompanying drawings.

Figure 1:
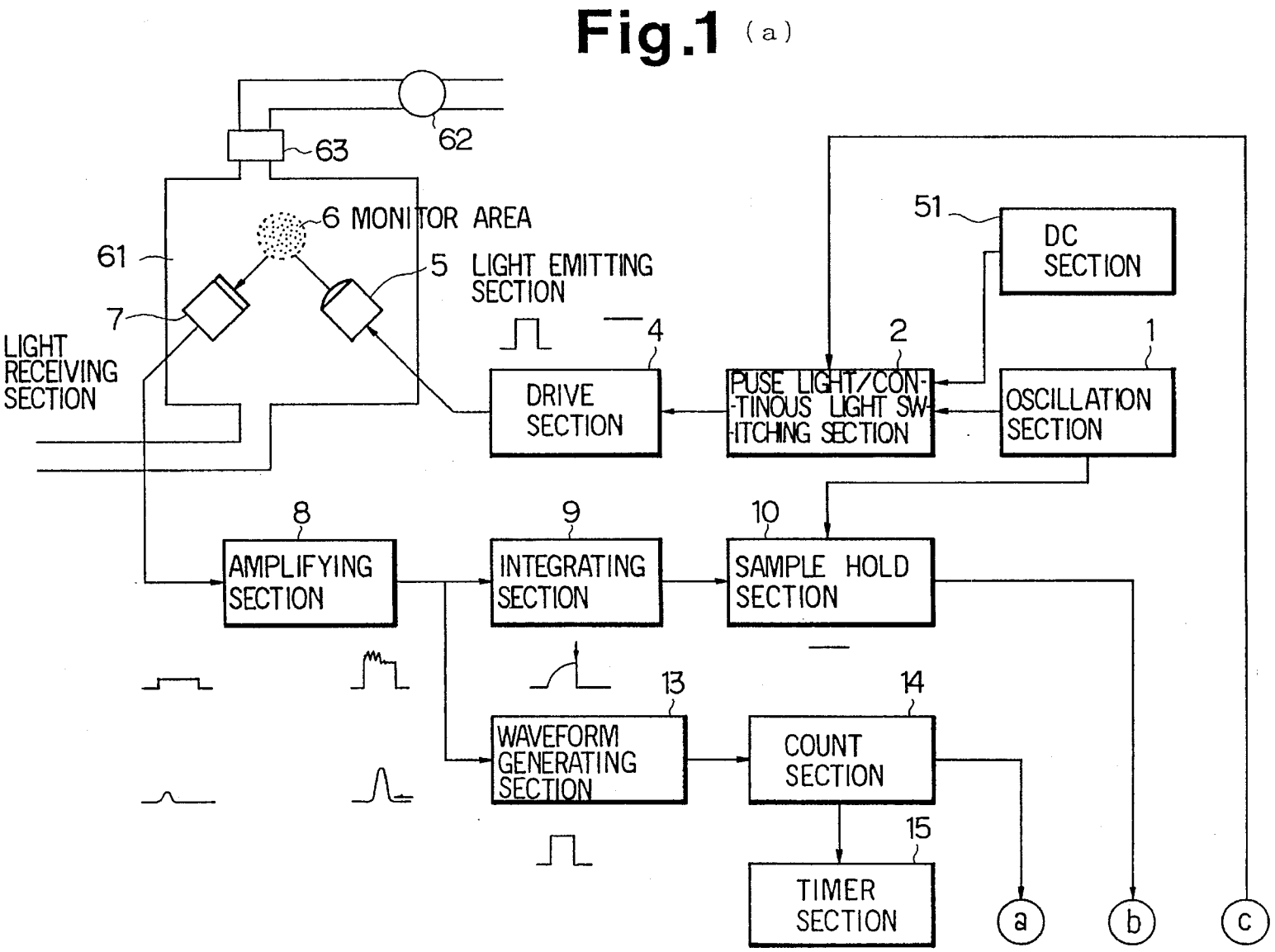
FIG. 1 is a block diagram illustrating the overall construction of a first embodiment of the present invention.
Figure 1B:
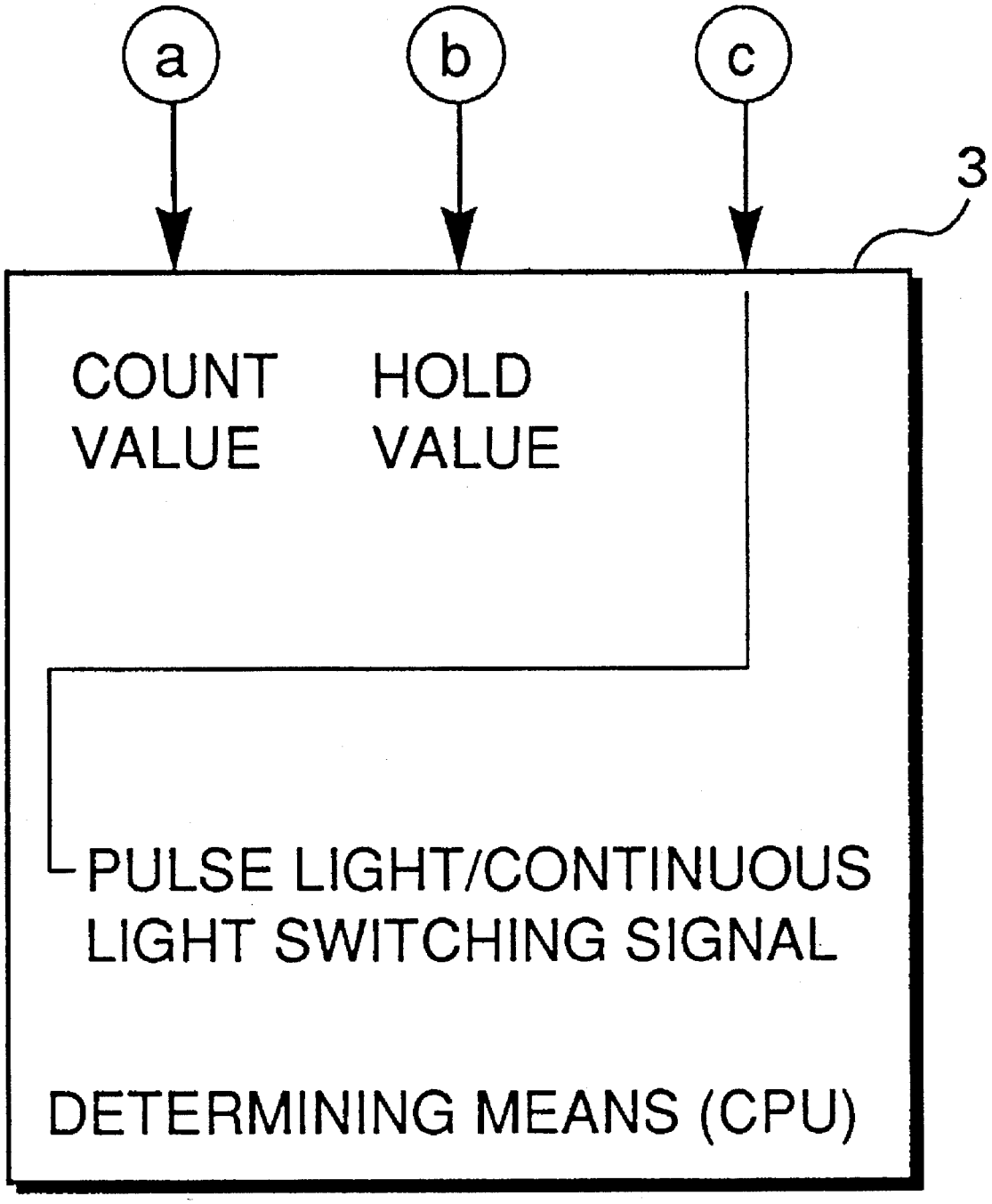

FIGS. 1 to 16 illustrate the first embodiment of the present invention. FIG. 1 is a block diagram illustrating the overall construction of a smoke detecting apparatus capable of detecting both smoke and fine particles in accordance with the first embodiment of the present invention.

First, the construction of the first embodiment will be explained. In FIG. 1, reference numeral 1 denotes an oscillating section which outputs a pulse voltage intermittently at a fixed period; reference numeral 51 denotes a DC section which outputs a continuous fixed voltage; and reference numeral 2 denotes a pulse-light/continuous-light switching section serving as means for switching pulse light and continuous light. The pulse-light/continuous-light switching section 2 switches an output of the oscillating section 1 and the DC section 51 in accordance with a pulse light/continuous light switching signal. As a result, an output to the next stage is converted into a pulsed or continuous fixed voltage.

Reference numeral 4 denotes a drive section serving as drive means, which continuously or intermittently drives a light emitting section 5 so as to make the section 5 serve as light emitting means. The light emitting section 5 intermittently or continuously projects a light beam onto a monitor area 6. The light emitting section 5 is formed of a halogen lamp, a laser diode, other LEDs, or the like, so that a light emission intensity of a predetermined value or more can be secured. As a result, it is possible to detect fine particles such as dust.

In this embodiment, the monitor area 6 is set within a fixed monitor area 61. Air is supplied through a pipe by a pump 62 from a room to be monitored or the like to the monitor area 61. A flow-rate meter 63 is disposed in the middle of the pipe, so that the amount of air supplied to the monitor area 6 can be measured. This flow-rate meter 63 makes it possible to detect a failure of the pump, clogging and disconnecting of the pipe, or the like, and to control the pump 62 on the basis of the measured data so that the amount of air supplied to the monitor area 6 can be maintained to be a constant amount. Although in this embodiment a flow-rate meter is used, a flow velocity meter or a pressure gauge may instead be used. The flow-rate meter may be mounted either in front of or in back of the monitor area 61.

Reference numeral 7 denotes a light receiving section serving as light receiving means, formed of a photodiode, so positioned that a light beam projected from the light emitting section 5 is not directly received by the light receiving section. When smoke generated by a fire flows into the monitor area 6, or fine particles such as dust are present in the monitor area 6, light is diffused by particles of smoke or fine particles, this diffused light entering the light receiving section 7.

Reference numeral 8 denotes an amplifying section serving as amplifying means, formed or operational amplifiers or the like, which amplifies the received light output of the light receiving section 7. Reference numeral 9 denotes an integrating section serving as computing means, which calculates the integrated value of the amplified output of the amplifying section 8.

Reference numeral 10 denotes a sample hold section which holds the peak value of the integrated value integrated by the integrating section 9 in synchronization with the oscillation output from the oscillating section 1 and which outputs the hold value to a CPU 3. Although in this embodiment the sample hold section 10 is used, an A/D converter may instead be used. That is, the integrated value integrated by the integrating section 9 may be converted into a digital value and then output to the CPU 3.

Figure 2:
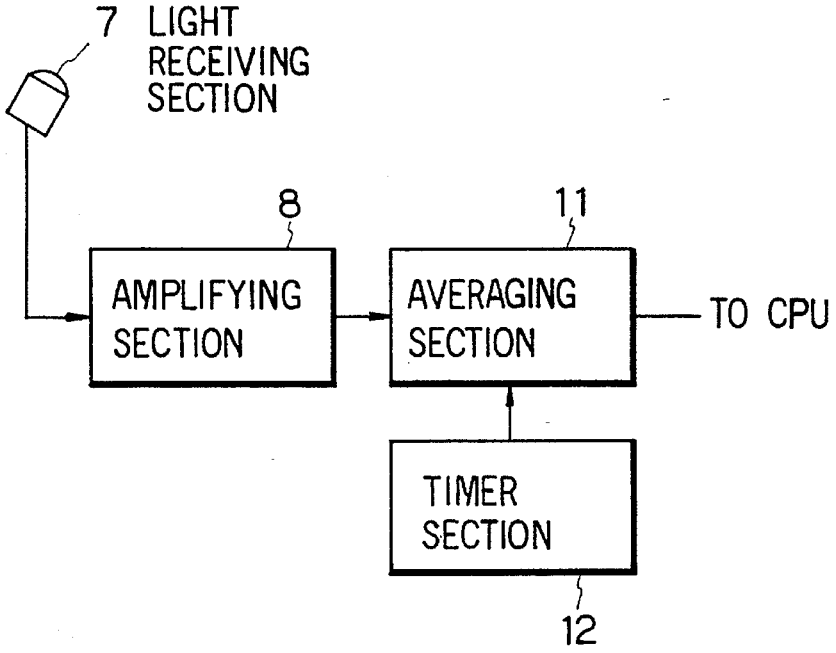
FIG. 2 is an illustration of the construction of the averaging section when the averaging section, instead of an integrating section, is used to process data.

Although in the embodiment shown in FIG. 1, the case in which the amplified output from the amplifying section 8 is integrated by the integrating section 9 has been described, this embodiment is not limited to such a case. For example, as shown in FIG. 2, an averaging section 11 and a timer section 12 may be used. That is, the average value of the amplified output may be computed at fixed time intervals, for example, at intervals of 10 seconds, so that the average value is output to the CPU 3. Referring to FIG. 1 again, reference numeral 13 denotes a waveform generating section which generates a waveform of the amplified output from the amplifying section 8.

Reference numeral 14 denotes a counting section serving as counting means, which counts an output from the waveform generating section 13 during a fixed time period, for example, at intervals of 10 seconds, output from a timer section 15, and which outputs the count value to the CPU 3.

The CPU 3 outputs the pulse light/continuous light switching signal to the pulse light/continuous light switching section 2. Also, the CPU 3 determines the level of a fire according to the density of smoke on the basis of a hold value from the sample hold section 10 or on the basis of an average value from the averaging section 11. Further, the CPU 3 serves as a determining means for determining the level of contamination of air on the basis of the count value from the counting section 14.

Next, an explanation will be given of the setting of the level of contamination of air and the level of a fire.

Figure 3:
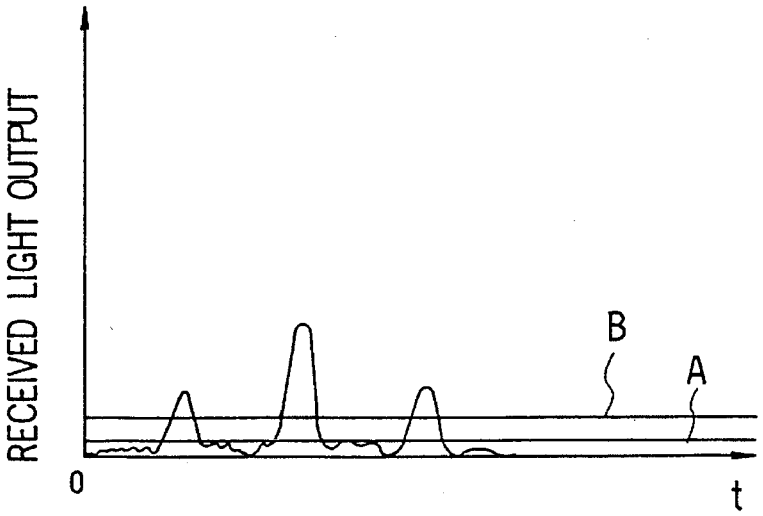
FIG. 3 is a graph illustrating an example of a received light output in an amplifying section.

FIG. 3 illustrates an output from the amplifying section 8.

When fine particles are detected, a count level B, which is a predetermined threshold value with respect to a count level A, is set. When the count level B is exceeded, this fact is counted. More specifically, a fixed time period, for example, 10 seconds, is set by the timer section 15, and the counting section 14 counts how many times the count level B is exceeded during the 10 second period. The counting condition may be set as desired, of course, for example, count level A may be set to be equal to count level B.

Figure 4:
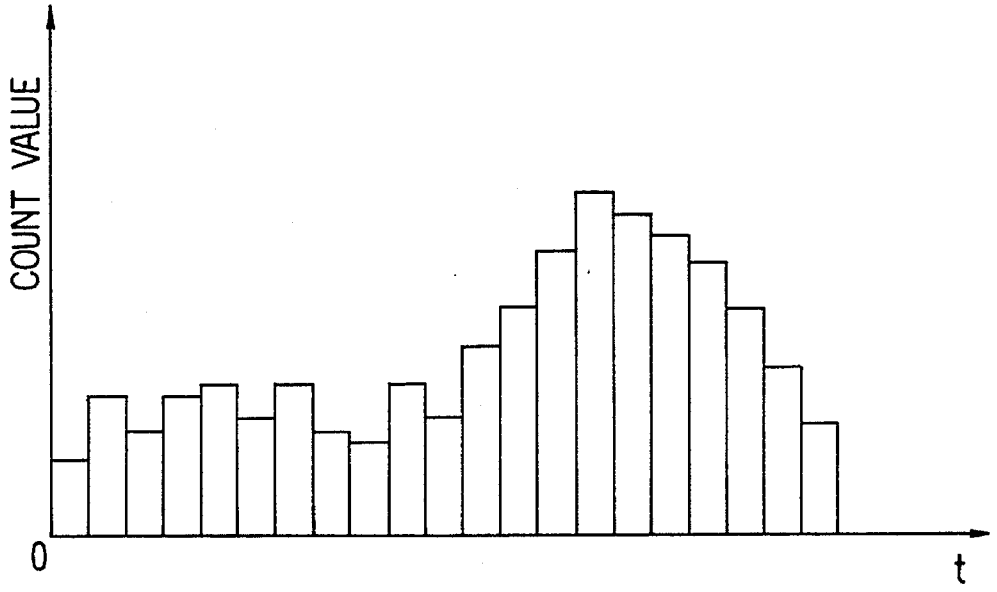
FIG. 4 is a graph illustrating a count value in units of time.

The count value per the fixed time period is shown in FIG. 4. More specifically, FIG. 4 shows how many times the predetermined count level is exceeded during a certain $\Delta t_n$ second period.

Figure 5:
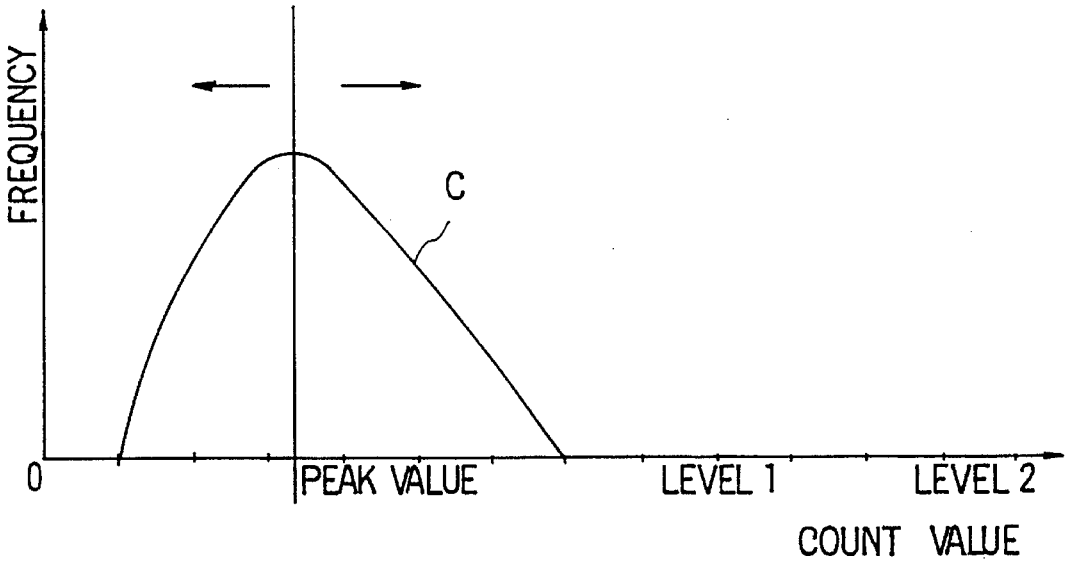
FIG. 5 is a graph illustrating the frequency of the counted number.

A graph in which the frequency of the appearance of the count value of FIG. 4 is depicted is shown in FIG. 5. In FIG. 5, the horizontal axis indicates the count value so that how many times a certain count value has appeared in a predetermined time period is indicated, and the distribution of this frequency is shown. The graph line C of FIG. 5 indicates the frequency of the appearance of the count value at normal times.

When the count value has exceeded the preset number of times, i.e., level 1, this is determined to be an environment abnormality level; when the count value has exceeded level 2, which is set higher than level 1, it is determined that a warning alarm level has been reached.

Figure 6:
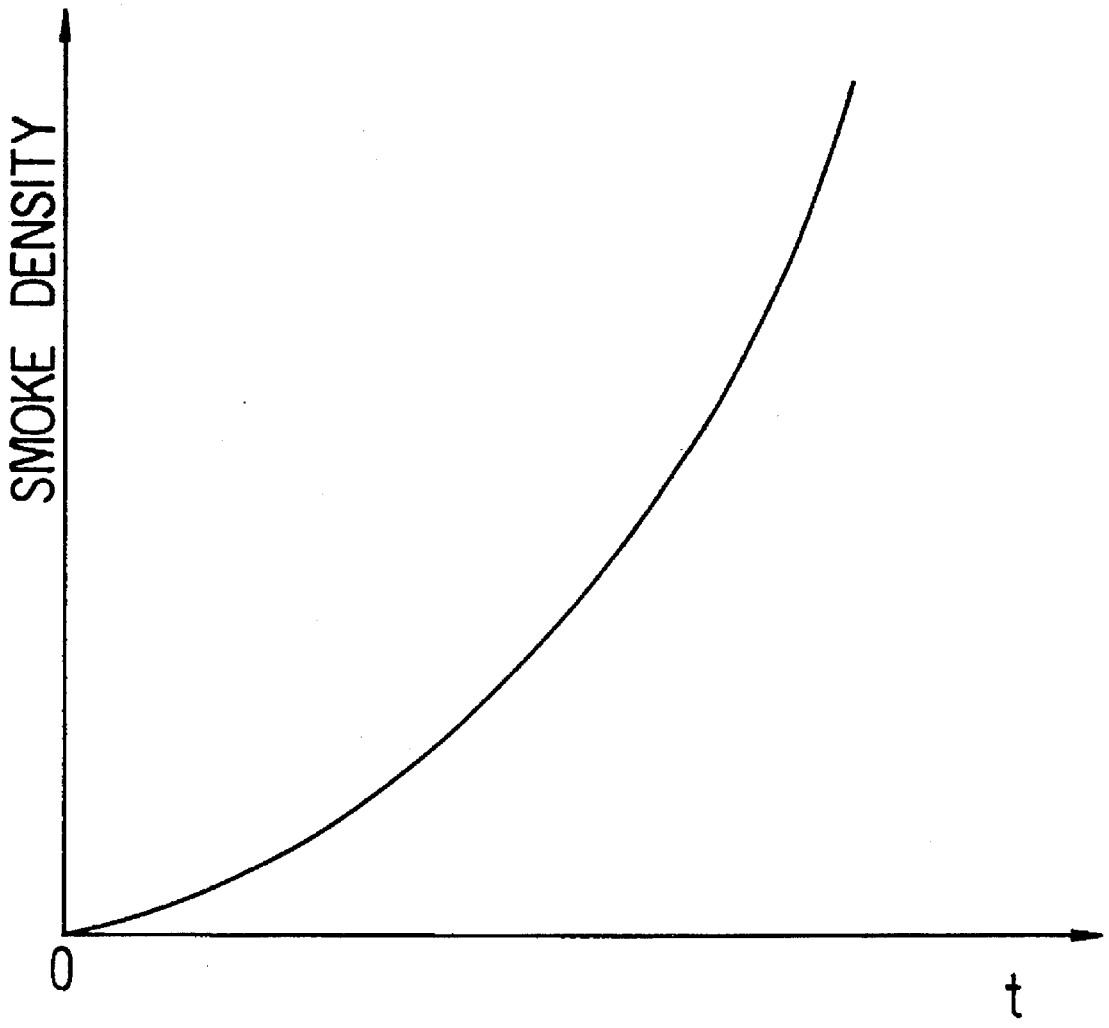
FIG. 6 is a graph illustrating the relationship between time and smoke density.
Figure 7:
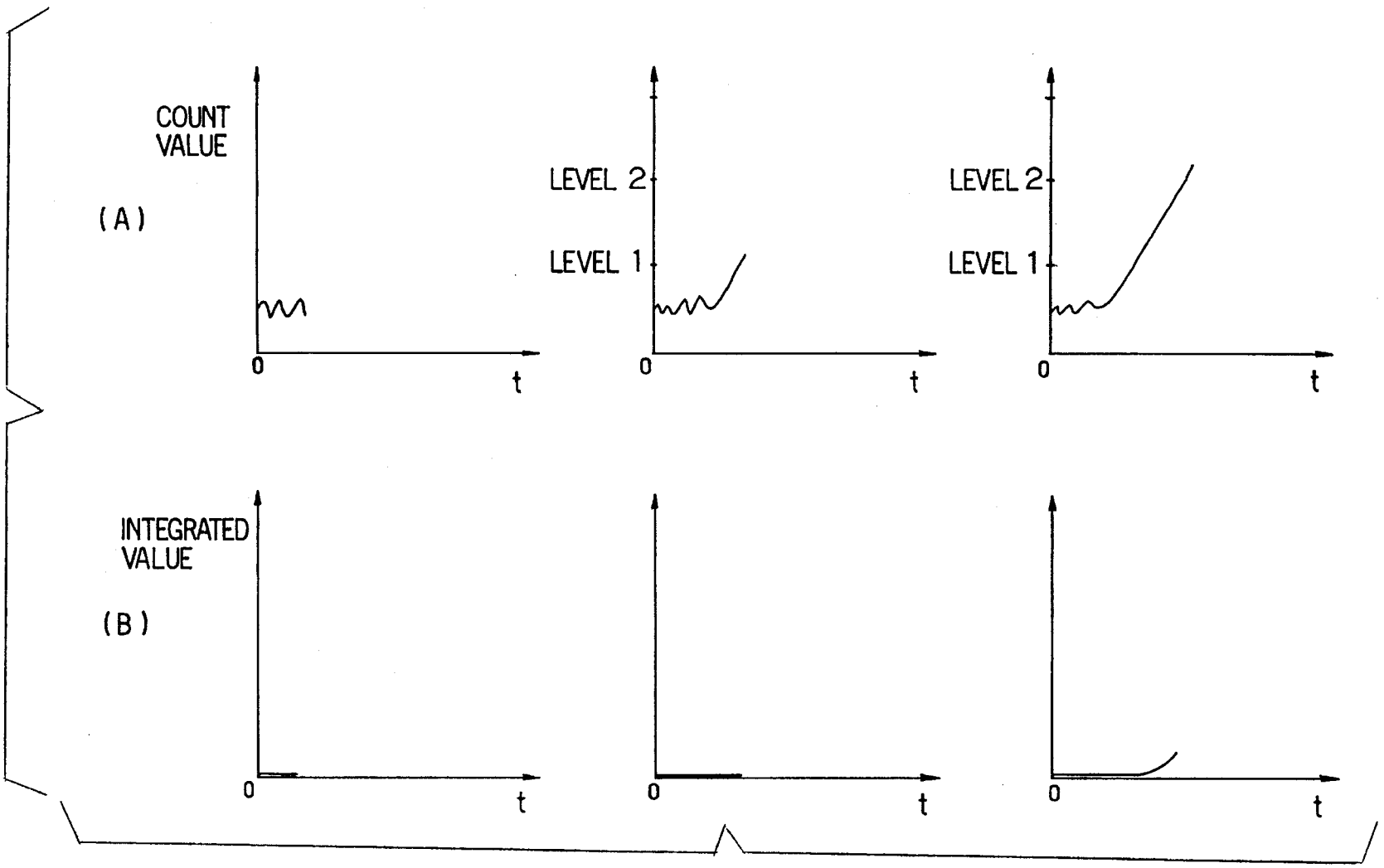
FIG. 7 is a graph illustrating the count value and the integrated value in the initial period of a fire.

Next, the relationship between the time from when a fire occurs and the density of smoke is shown in FIG. 6.

As shown in FIG. 6, the smoke density increases in proportion to the time. That is, the smoke density is low in the initial period of the fire, and the volume of smoke particles is small. Therefore, in this case, as shown in FIG. 7(B), the integrated value integrated by the integrating section 9 is small.

Figure 8:
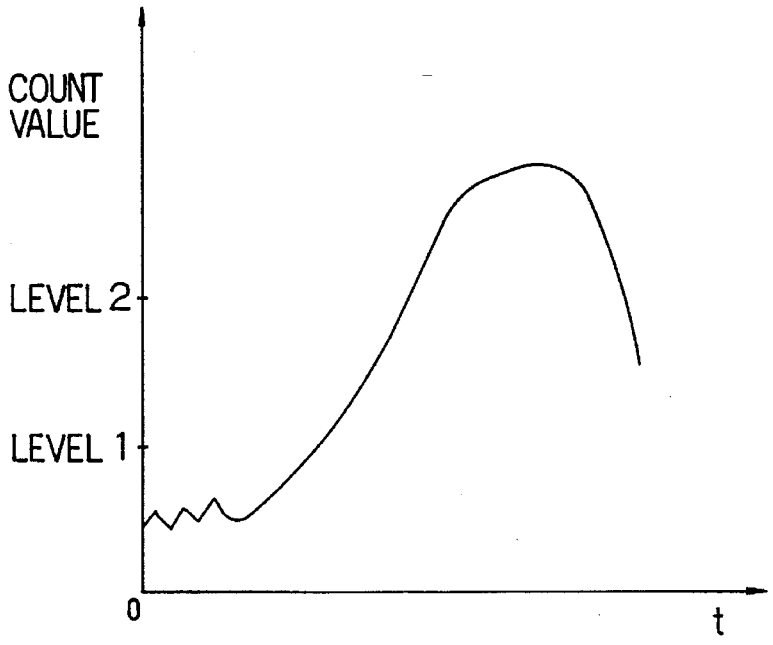
FIG. 8 is a graph illustrating the relationship between time and the count value.

On The other hand, the count value by the counting section 14 records an increase in the fine particles from the initial period of the fire, as shown in FIG. 7(A). However, since the received light output of the light receiving section 7 increases when the smoke density increases, a saturation point is reached and counting becomes impossible, as shown in FIG. 8.

Figure 9:
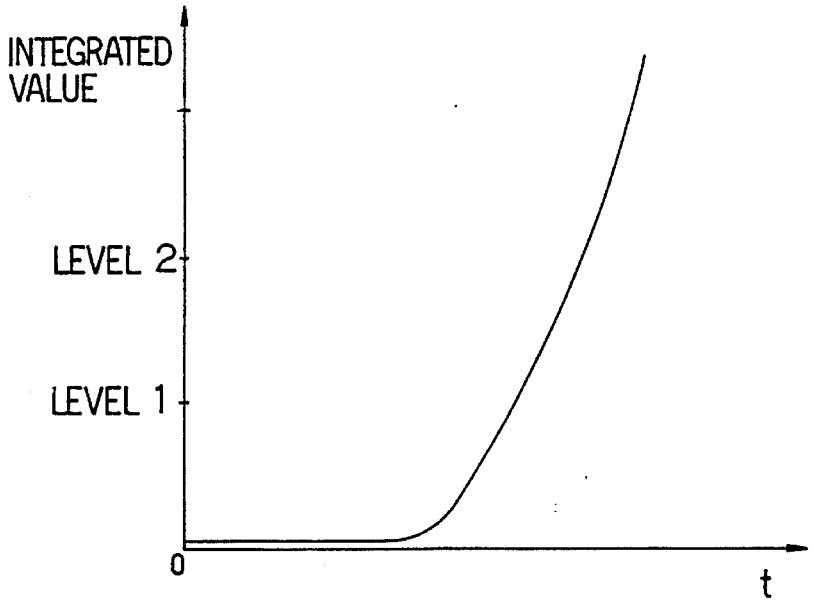
FIG. 9 is a graph illustrating the relationship between time and the integrated value.

In this way, when the smoke density increases, as shown in FIG. 9, the integrated value calculated by the integrating section 9 increases sharply. When, for example, the integrated value exceeds level 1 of FIG. 9, this is determined to be a pre-alarm level. When the integrated value exceeds level 2, this is determined to be a fire level. Note, it is possible to change the above mentioned level 1 and level 2 in accordance with an environment.

Figure 17:
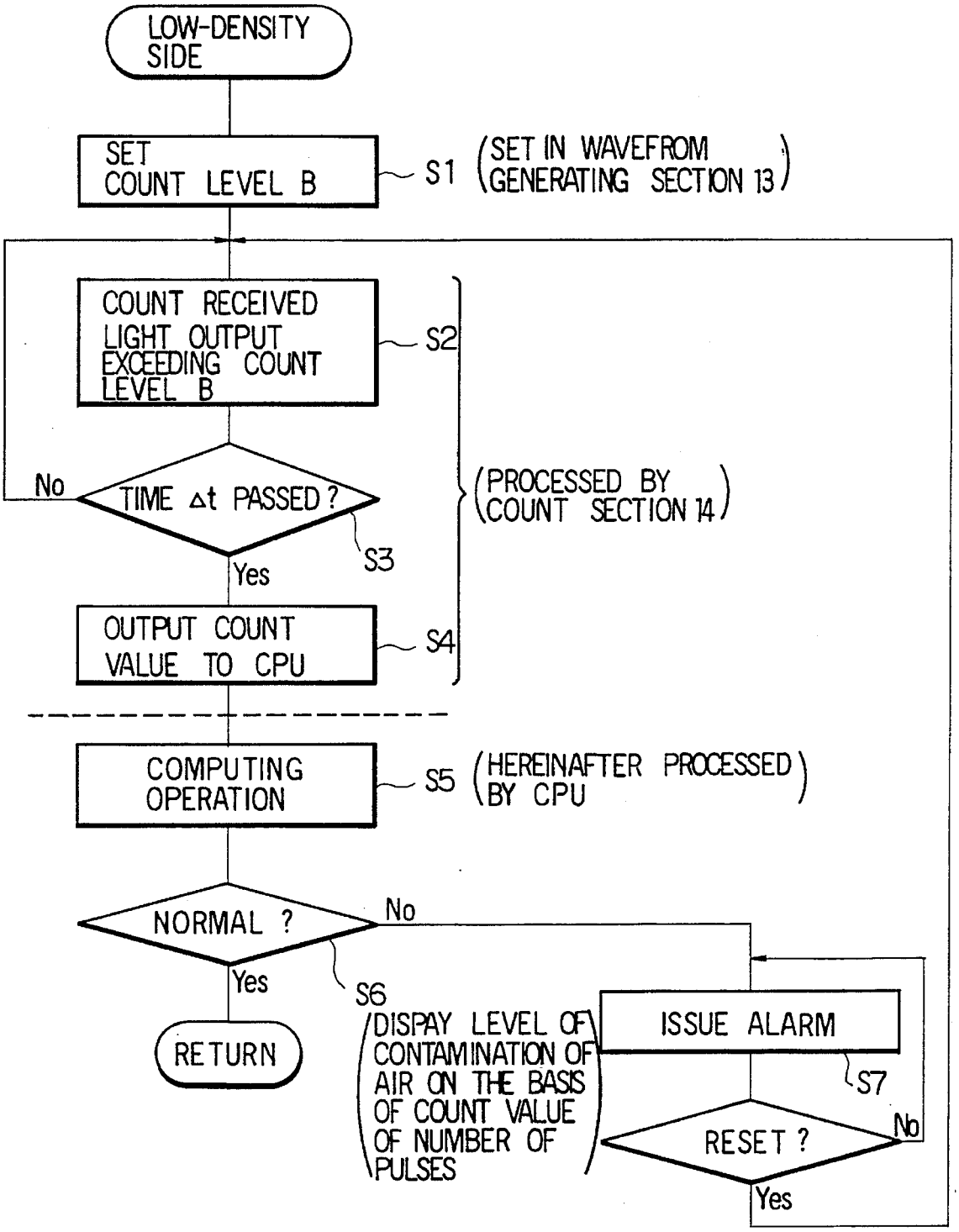
FIG. 17 is a flowchart illustrating the operation sequence of the first embodiment when the smoke density is low.

Next, the operation of this embodiment will be explained. FIG. 17 is a flowchart illustrating the operation sequence of the low density side in accordance with The first embodiment.

First, a description will be given of a case in which the light emission of the light emitting section 5 is continuous light.

Figure 10:
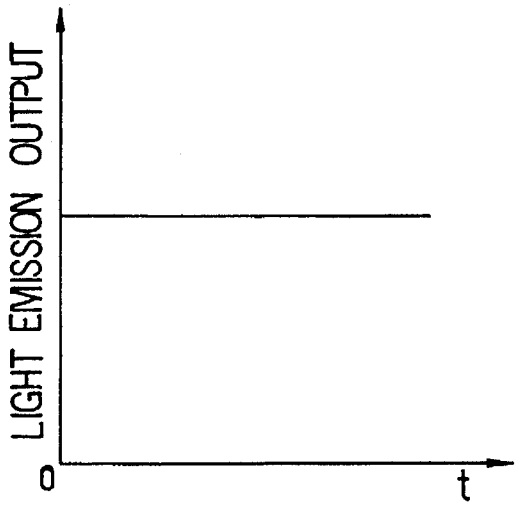
FIG. 10 is a graph illustrating the light emission output of continuous light.

When a pulse-light/continuous-light switching signal indicating that continuous light be selected is output from the CPU 3 to the pulse-light/continuous-light switching section 2, the pulse-light/continuous-light switching section 2 switches to a continuous fixed voltage of the DC section 51 and outputs it to the drive section 4. The drive section 4 drives the light emitting section 5 by a continuous fixed voltage. The light emitting section 5 projects a light beam onto the monitor area 6. The light emission output of The light emitting section 5 is shown in FIG. 10. The light emission output of the light emitting section 5 is a fixed output in relation to time, as shown in FIG. 10.

Figure 11:
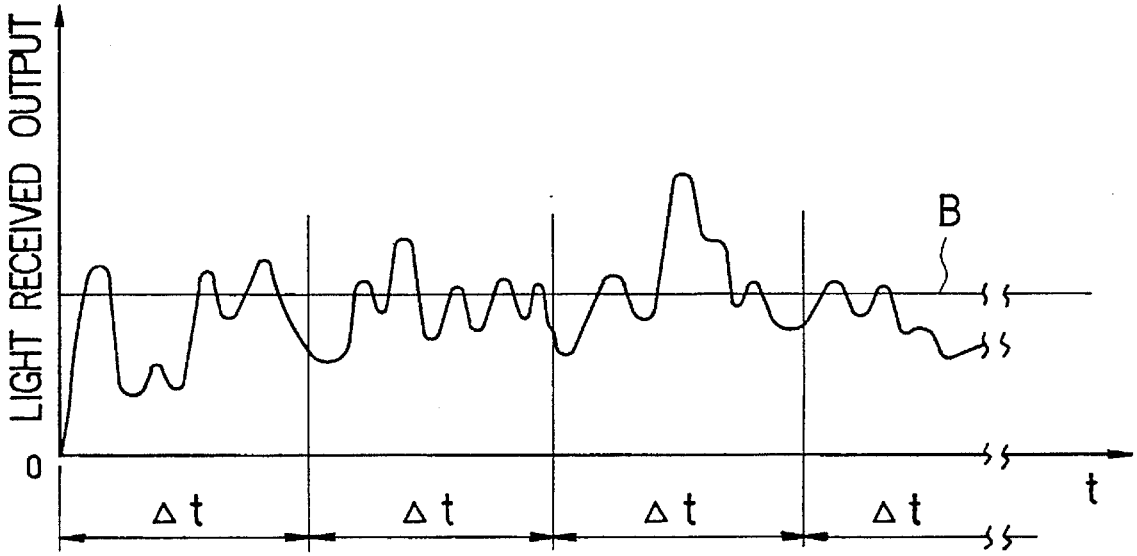
FIG. 11 is a graph illustrating the received light output of fine particles.

When fine particles such as dust are present in the monitor area 6, or when smoke particles caused by a fire enters the monitor area 6, diffused light occurs. The diffused light is received by the light receiving section 7. The received light output of the light receiving section 7 is amplified by the amplifying section 8. The received light output amplified by the amplifying section 8 is shown in FIG. 11 showing the detected fine particles.

When the fine particles of the low-density side are detected, first, count level B is set (Step 1, hereinafter abbreviated as S1), so that it is counted how many times a received light output exceeding the count level B has occurred in a fixed period of time $\Delta t$ (S2, S3).

Figure 12:
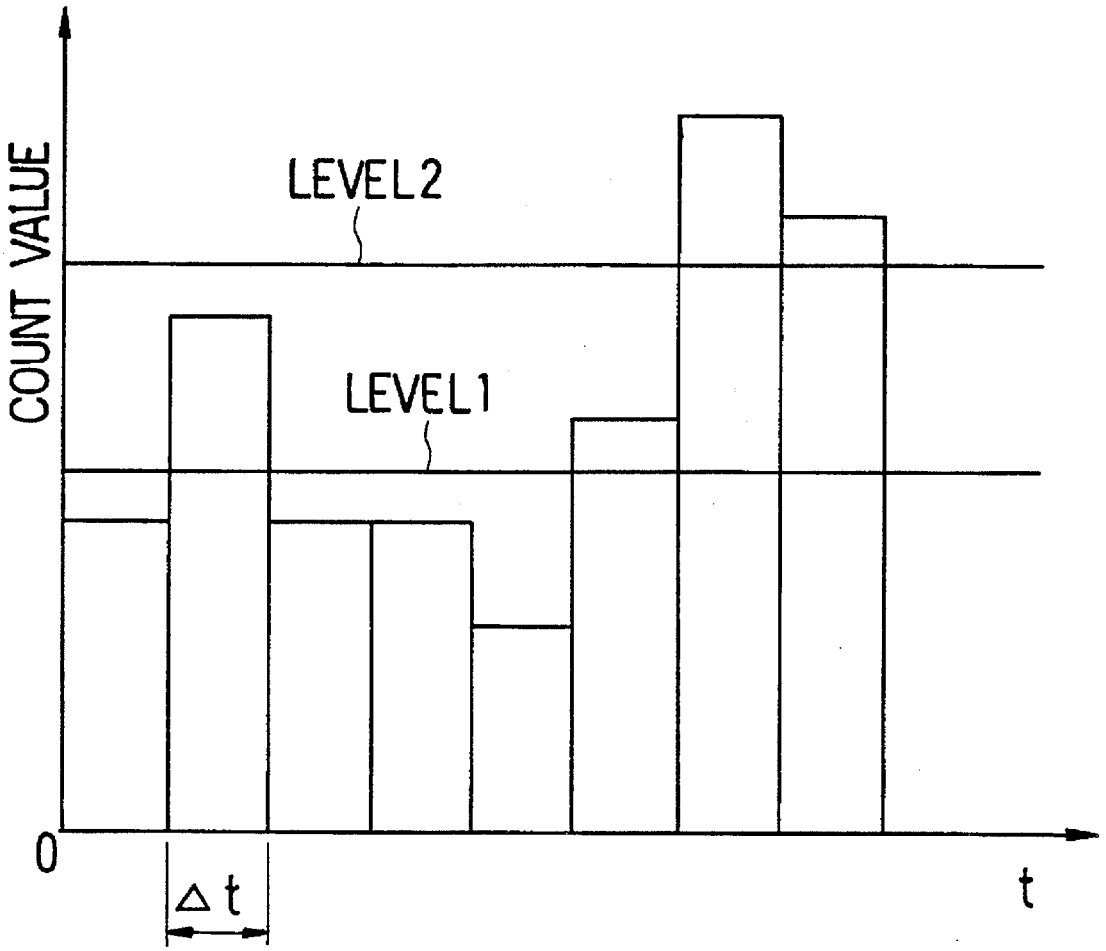
FIG. 12 is a graph illustrating the count value in units of fixed time.

The count value at intervals of a fixed period of time is shown in FIG. 12. It can be seen from FIG. 12 how many times the output exceeding the count level B has occurred in a fixed period of time.

The count value counted by the counting section 14 is output to the CPU 3 (S4). The CPU 3 determines the air contamination level on the basis of the count value (S5, S6). When, for example, the count value exceeds level 1, it is determined that the contamination is at an environmental abnormality level. When the count value exceeds level 2, it is determined that the contamination is at an fire warning alarm level. Based on the above, a warning is issued (S7).

Figure 13:
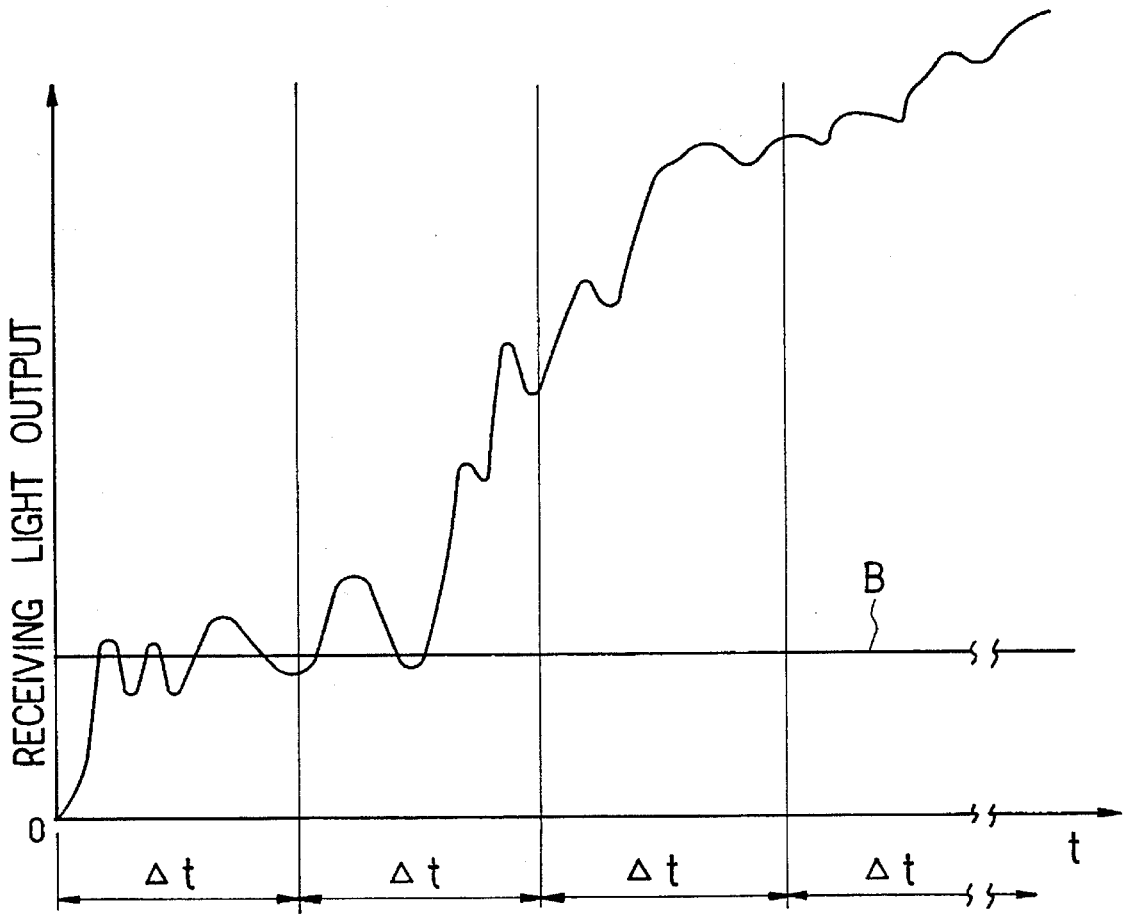
FIG. 13 is a graph illustrating the received light output of the amplifying section when the smoke density increases due to a fire.
Figure 18:
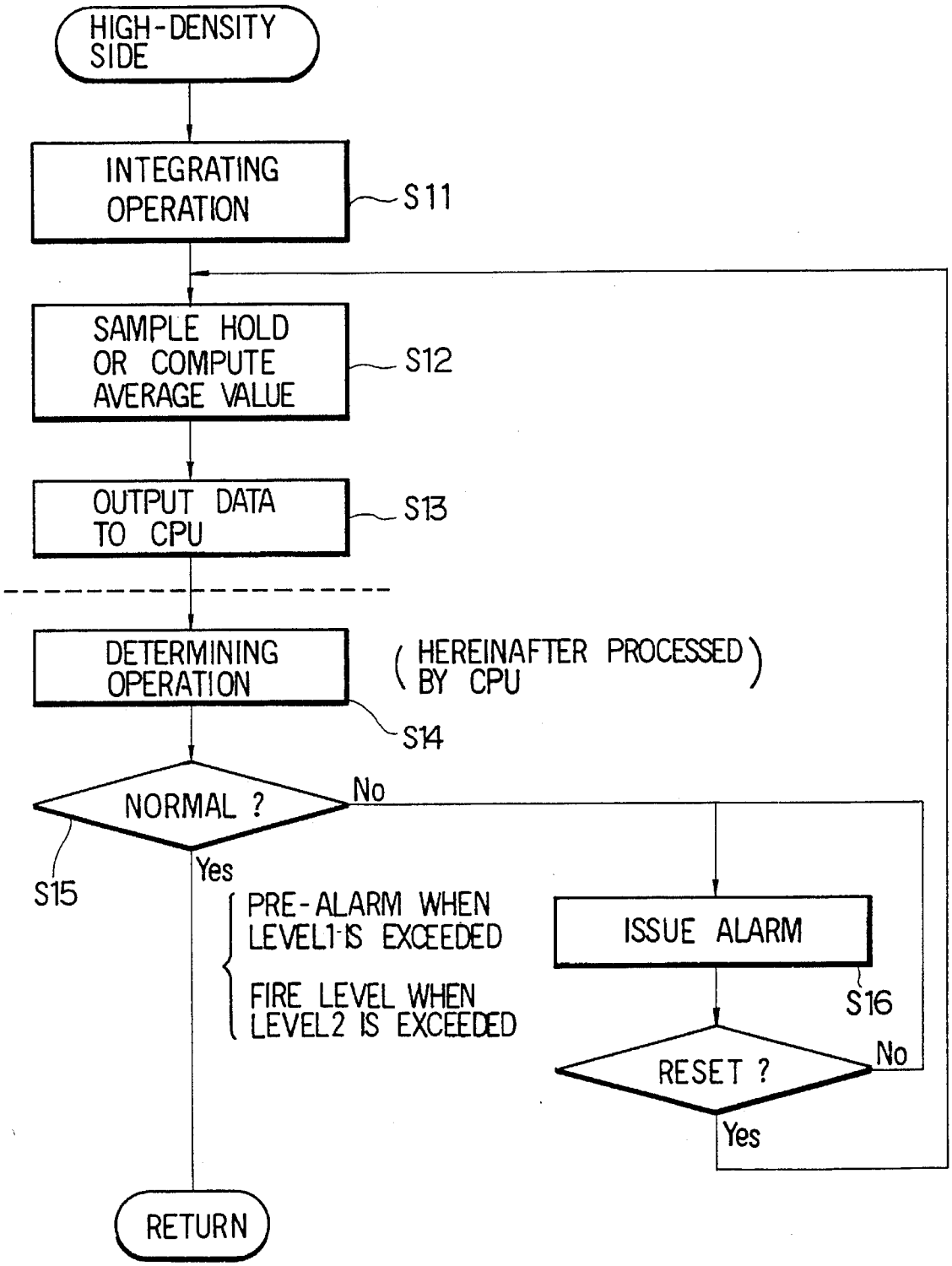
FIG. 18 is a flowchart illustrating the operation sequence of the first embodiment when the smoke density is high.

Next, the received light output of the amplifying section 8 when the smoke density increases due to a fire is shown in FIG. 13. FIG. 18 is a flowchart illustrating the operation sequence in this case.

Figure 14:
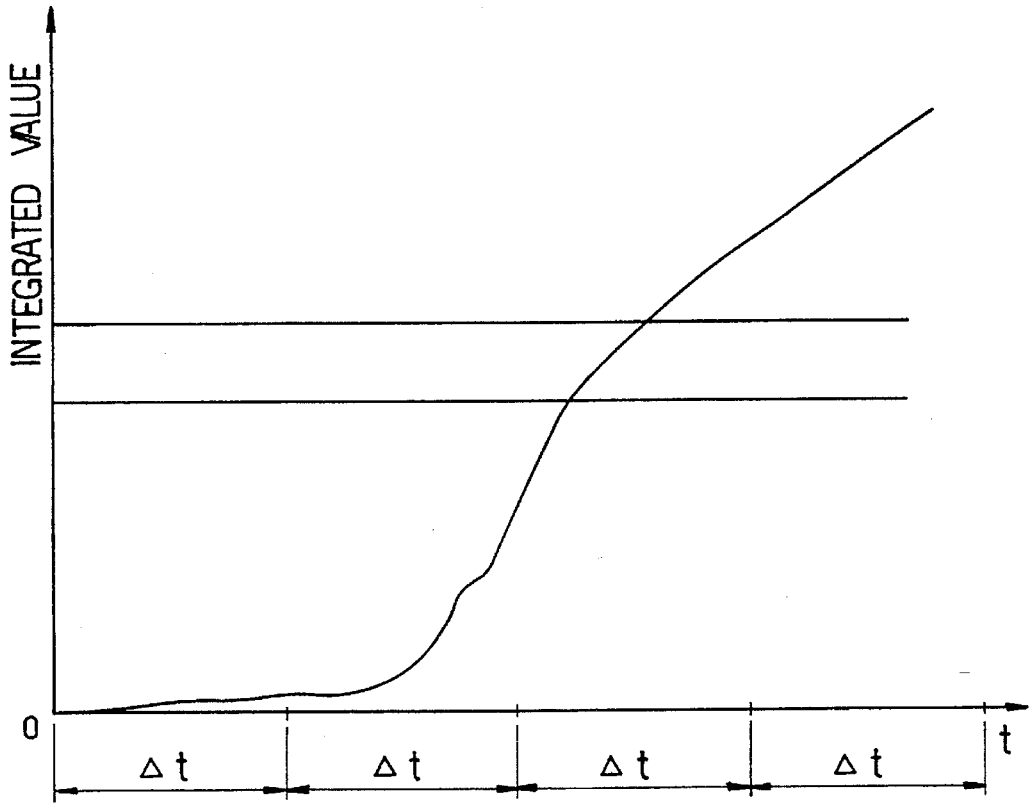
FIG. 14 is a graph illustrating the integrated value obtained by integrating the received light output of the amplifying section by the integrating section.

After a lapse of the initial period of the fire, the smoke density increases, and the received light output increases sharply. Under these circumstances, the count value such that the number of times a certain level has been exceeded is saturated because the output value exceeds the level, making it impossible to count. Therefore, data indicating the count value, shown in FIG. 12, can no longer be obtained. In this case, the received light output of the amplifying section, which has been integrated, is used (S11). The received light output of the amplifying section 8, which has been integrated by the integrating section 9, is shown in FIG. 14.

Figure 15:
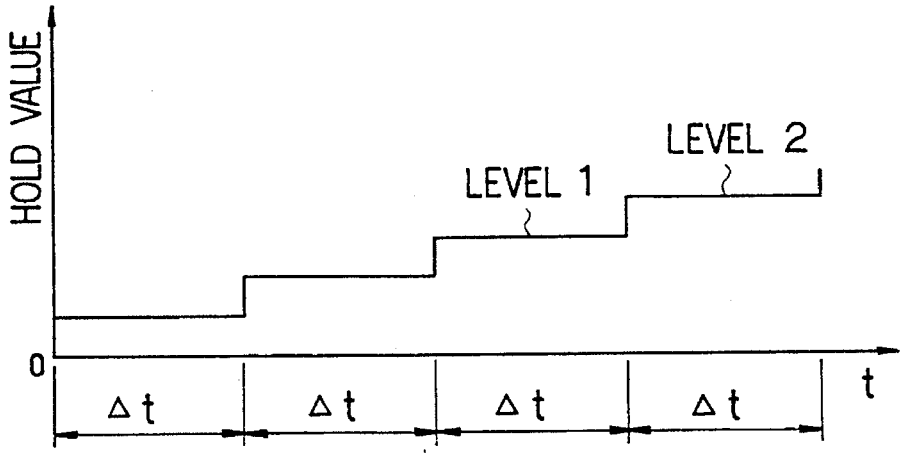
FIG. 15 is a graph illustrating the hold value obtained by sample holding the peak of the integrated value computed by the integrating section by using a sample hold section.

The peak of the integrated value integrated by the integrating section 9 is sample held by the sample hold section 10 in units of a fixed time $\Delta t_n$ (S12). The hold value which has been sample held is shown in FIG. 15.

Figure 16:
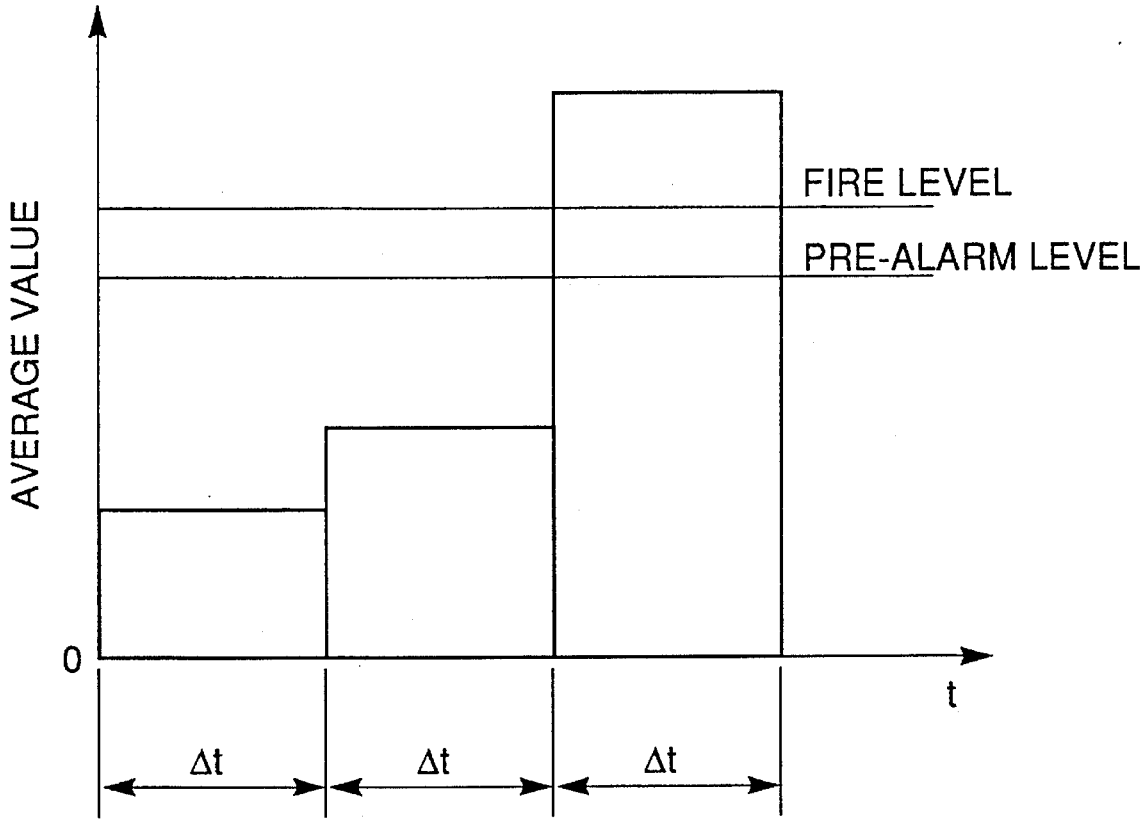
FIG. 16 is a graph illustrating the average value of the received light output of the amplifying section at fixed time intervals.

The average value obtained by the averaging section 11 calculating the average of the received light output of the amplifying section 8 in units of the fixed time $\Delta t_n$ is shown in FIG. 16. This hold value or average value is output to the CPU 3 (S13). The CPU 3 determines the fire level on the basis of the hold value or average value of the integrated value (S14, S15). When, for example, the hold value or the average value exceeds level 1, this is determined to be a pre-alarm level. When the hold value or the average value exceeds level 2, this is determined to be a fire level. Based on the above, a warning is issued (S16).

As described above, since in this embodiment even fine particles are detected, it is possible to detect very thin smoke generated in the initial period of a fire, and to give a fire warning alarm. Also, since the level of contamination of the air can be detected, it is possible to distinguish environmental abnormalities. In addition, since it is possible to detect both fine particles and smoke by a single apparatus without disposing a fine particles detecting sensor, costs can be reduced. Further, since the hold value or average value of the smoke density is calculated, even if the smoke density increases, it is possible to reliably detect a fire without deteriorating a distinguishing function.

Figure 19:
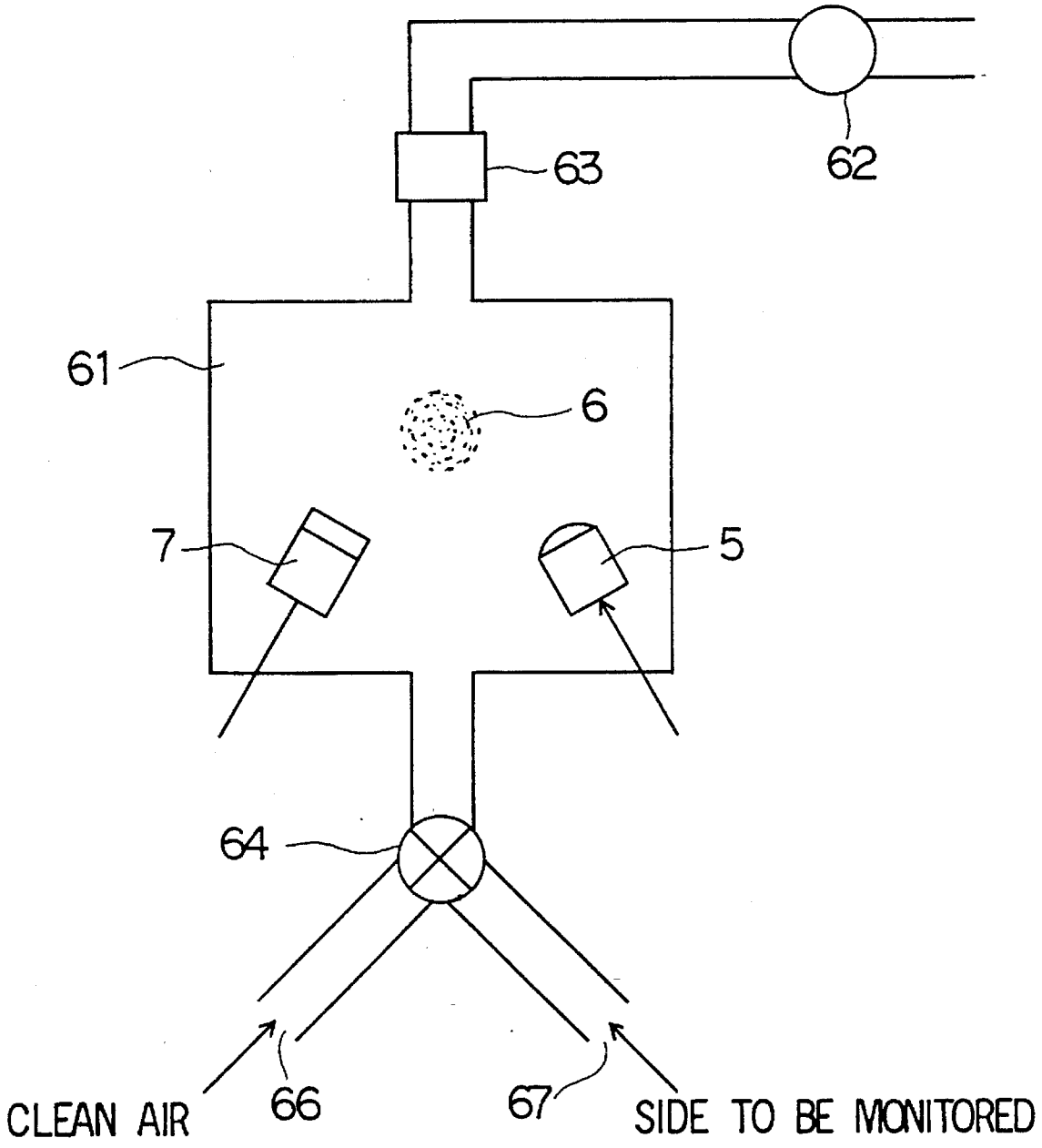
FIG. 19 is an illustration of the system configuration in a case in which a monitor area is cleaned and fine particles are detected.

Also, in this embodiment the inside of the monitor area 6 may be cleaned periodically. The system configuration is shown in FIG. 19. In this case, a switching valve 64 is disposed in the stage anterior to the monitor area 61, as shown in FIG. 19, so that the air and clean air of the room to be monitored can be switched by the switching valve 64. Here, the switching valve 64 is switched to a side 67 where air to be monitored is taken in at normal times. In this embodiment, the switching valve 64 is periodically switched to a clean air side 66. Therefore, the inside of the monitor area 61 is periodically cleaned, making it possible to accurately measure fine particles in the air to be monitored. It is also possible to confirm that the monitor area 61 has been cleaned on the basis of data during this cleaning and then restart normal monitoring, and at the same time it is possible to confirm whether the measuring apparatus is normally operating.

In such a system, influence exerted upon data due to contamination or deterioration of the optical system is considered. Thus, it is also effective in this embodiment to detect contamination or deterioration of the optical system or the like, and to correct sensitivity in connection with the detection.

As a first method, there is a method in which the time during which the apparatus is used is recorded, and when a fixed time has passed, a warning is issued. As subjects of an alarm, there are pumps, lamps, LEDs or the like. According to this method, it is possible to manage apparatuses very easily.

Figure 20:
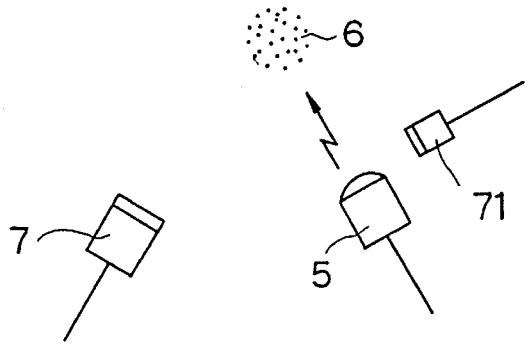
FIG. 20 illustrates an example of the system configuration for detecting contamination of an optical system.

Whereas the first method makes it possible to manage apparatuses very easily as described above, it has drawbacks in that it is not possible to cope with sudden failures or a decrease in sensitivity due to deterioration. Therefore, to cope with such a case, it may be considered that a second light receiving means 71, such as a photodiode, be disposed in the vicinity of the light emitting means shown in FIG. 20. In this case, the light emission state of the light emitting section 5 is monitored by the second light receiving means 71 at all times. As a result, even if the amount of the light emission of the light emitting section 5 is decreased due to contamination or deterioration, its circumstance can be known immediately. Thus, it is possible to maintain control so that the amount of the light emission of the light emitting section 5 is maintained constant on the basis of the data thus obtained. In this case, when there is no longer an output from the second light receiving means 71, a failure of the light emitting section 5, for example, a burnt-out lamp, may be considered. Thus, in such a case, a warning may be issued so as to immediately notify an operator of the failure.

Figure 21:
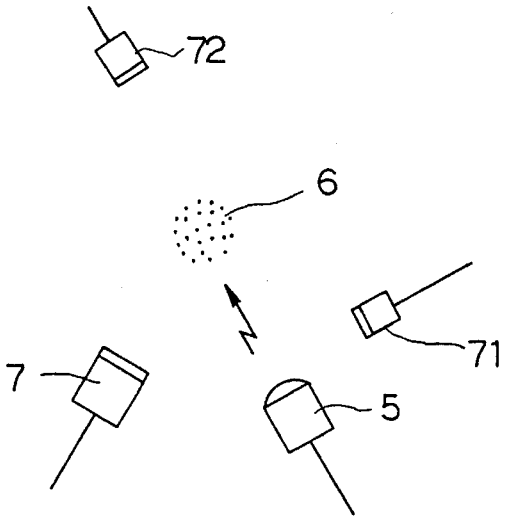
FIG. 21 illustrates another example of the system configuration for detecting contamination of the optical system.

Next, as a second method, in addition to the abovementioned second light receiving means 71, a light receiving means 72 of FIG. 3 may be disposed at a position where light from the light emitting section 5 directly enters, as shown in FIG. 21. In this arrangement, the amount of light received by the second light receiving means 71 should become equal to that of the light receiving means 72. Therefore, when the difference between the amounts of light received by the light receiving means equals or exceeds a fixed amount, it is determined that some failure has occurred and a warning is issued.

Figure 22:
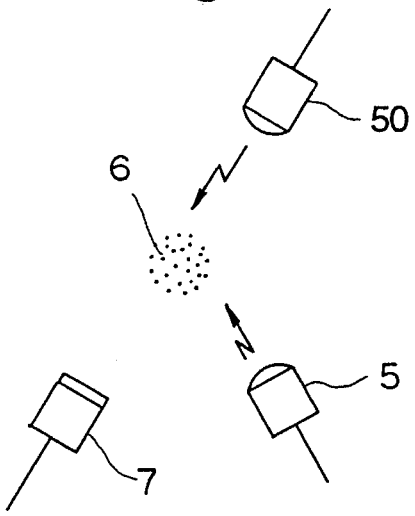
FIG. 22 illustrates still another example of the system configuration for detecting contamination of the optical system.

As a third method, a construction may be considered in which the second light emitting means 50 be disposed as shown in FIG. 22. In this construction, a test beam of a fixed amount is emitted from the second light emitting means 50 at intervals of a fixed time. And then, the amount of light received by the light emitting section 5 during the light emission of the test beam is measured. At this time, the amount of the test beam from the second light emitting means 50 is significantly larger than the diffused light due to fine particles, and the amount of the test beam is considered to be nearly constant at all times. Therefore, correcting the sensitivity of the light receiving section 7 by using the amount of light received at this time as a reference makes it possible to eliminate influences due to contamination or the like. At this time, a test can also be performed in a condition in which the amount of light of the test beam of the second light emitting means 50 is switched at a plurality of steps. If such a method is used, it is possible to correct the gradient of the sensitivity characteristics of the light receiving section 7, so that a more precise sensitivity correction is made possible. At this time, also, when an output from the light receiving section 7 is lower than a fixed value during the test, this is determined to be a failure, and a warning can be issued.

As another example, deterioration can be detected by detecting the consumed electric current in the light emitting section 5. In this case, when it is detected that an electric current of a fixed amount or more is flowing through the light emitting section 5, this indicates some abnormality has occurred in the light emitting section 5, and a warning is issued.

Next, FIGS. 23 to 29 illustrate the second embodiment of the present invention.

In this embodiment, a case in which the light emitting section 5 emits light intermittently is shown.

Figure 23:
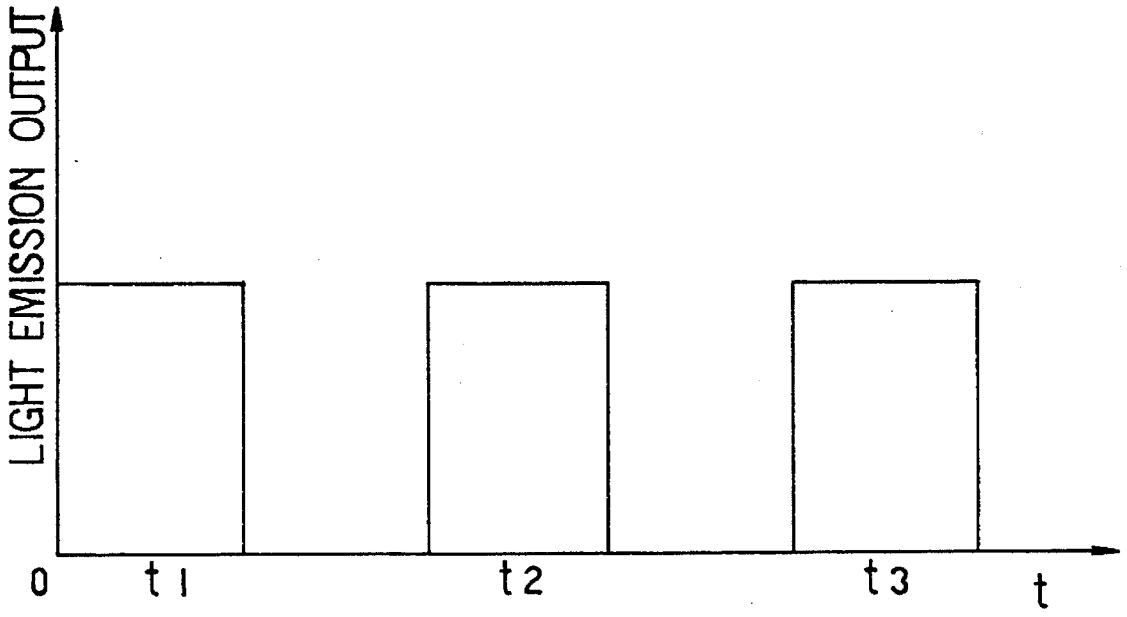
FIG. 23 is a graph illustrating the light emission output of pulse light in accordance with a second embodiment of the present invention.

In FIG. 1, when the CPU 3 outputs a pulse light/continuous light switching signal indicating that pulse light be selected, to the pulse-light/continuous-light switching section 2, the pulse-light/continuous-light switching section 2 switches so that the pulses output from the oscillating section 1 are output to the drive section 4. The drive section 4 intermittently drives the light emitting section 5. When it does, as shown in FIG. 23, the light emitting section 5 projects a pulse light corresponding to an oscillation frequency f0 onto the monitor area 6.

Figure 24:
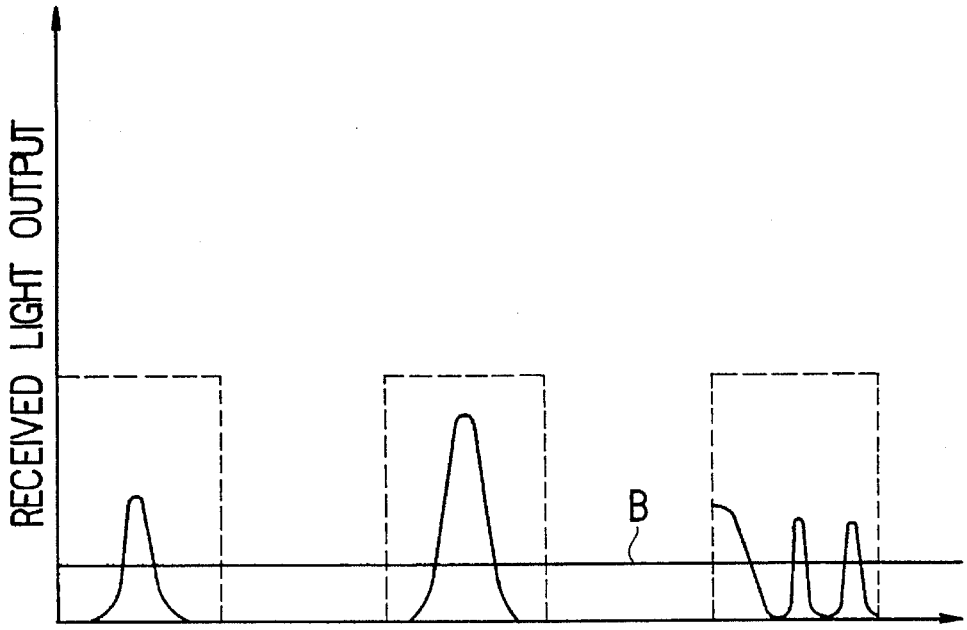
FIG. 24 is a graph illustrating the received light output of fine particles in the amplifying section.
Figure 25:
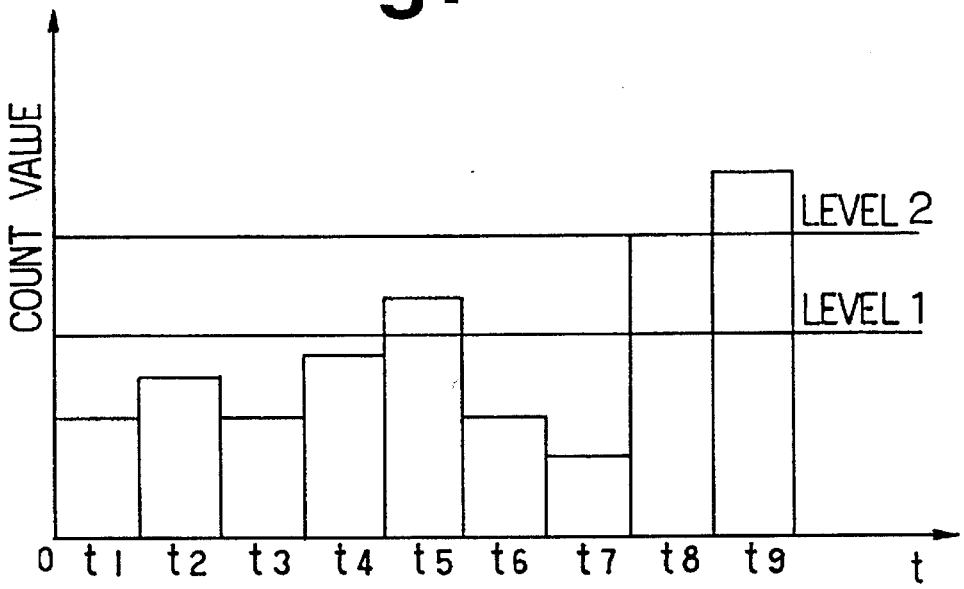
FIG. 25 is a graph illustrating the count value per a fixed period of time.

When fine particles such as dust are present in the monitor area 6, or when smoke particles caused by a fire enter the monitor area 6, diffused light occurs, and the diffused light is received by the light receiving section 7. The received light output of the light receiving section 7 is amplified by the amplifying section 8. When fine particles such as dust are present in the monitor area 6, received light output corresponding to the fine particles is obtained. The received light output of the amplifying section 8 in this case is shown in FIG. 24. FIG. 24 illustrates a state of detected fine particles, output at intervals of a fixed period (t1 to tn).

When fine particles are detected, the count level B is set at intervals of a fixed period (t1 to tn). Only when this count level is exceeded, is the received light output counted. That is, after the waveform of the received light output of the amplifying section 8 is generated by the waveform generating section 13, the count value by the counting section 14 is shown at intervals of a fixed period (t1 to tn) in FIG. 25.

Next, when smoke particles caused by a fire enter the monitor area 6, received light output of an amount corresponding to the smoke particles can be obtained.

Figure 26:
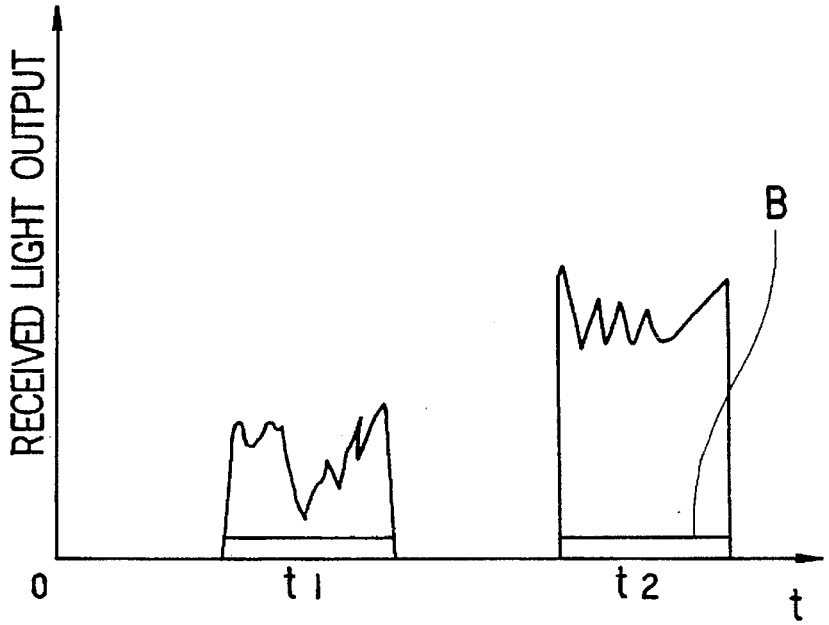
FIG. 26 is a graph illustrating the received light output of smoke in the amplifying section.
Figure 27:
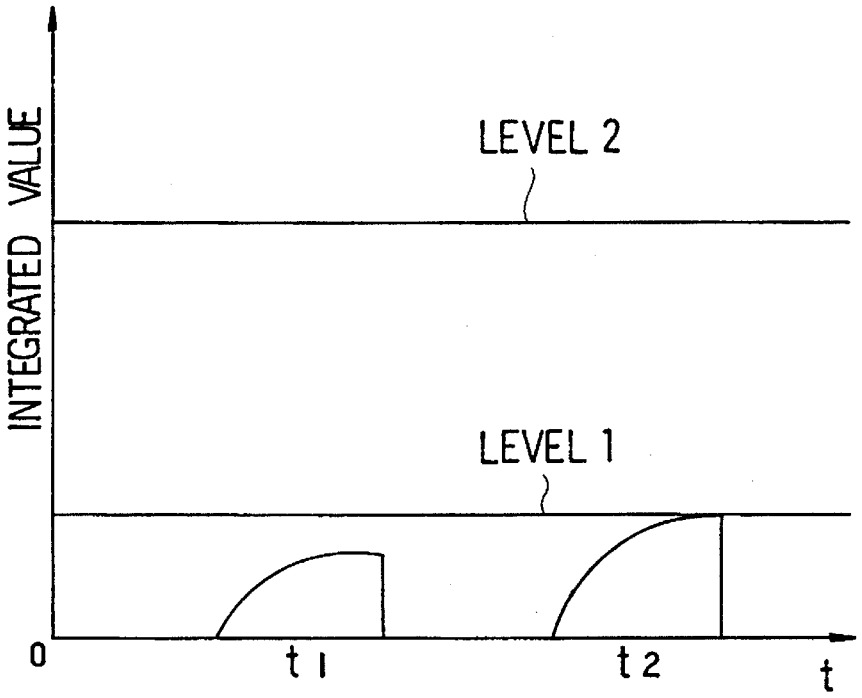
FIG. 27 is a graph illustrating the integrated value.
Figure 28:
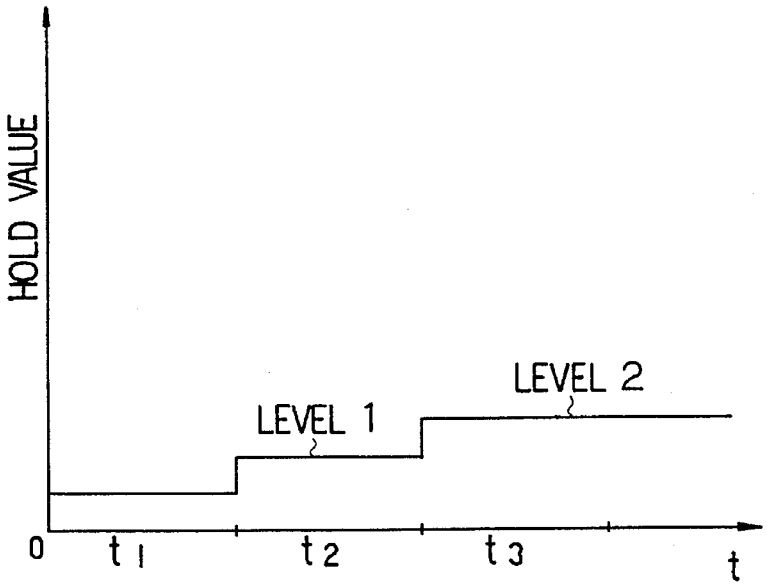
FIG. 28 is a graph illustrating the hold value.
Figure 29:
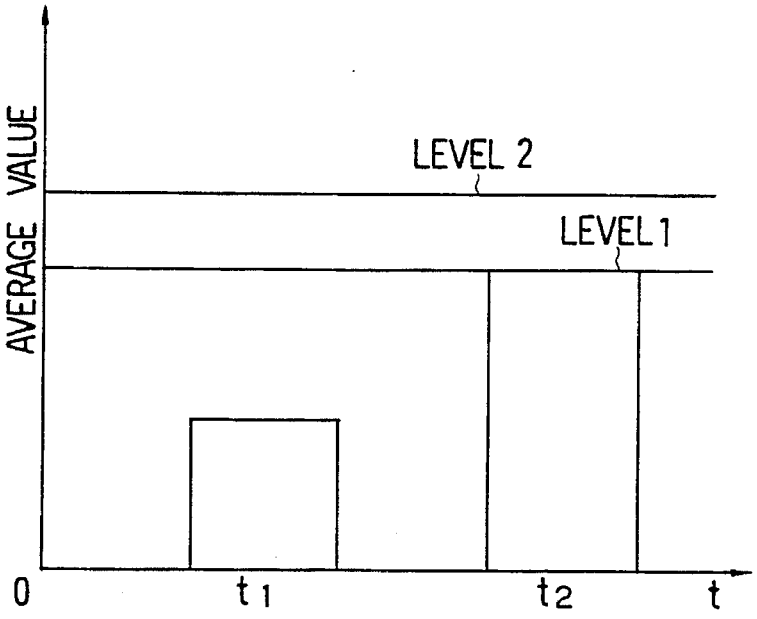
FIG. 29 is a graph illustrating the average value.

The received light output of the amplifying section 8 in this case is shown in FIG. 26. It is integrated by the integrating section 9. The received light output of the integrating section 9 is shown in FIG. 27. As regards the output of the integrating section 9, the sample hold value is shown in FIG. 28. The average value of the received light output of the amplifying section 8, averaged by the averaging section 11 at a fixed period, is shown in FIG. 29.

The hold value of the integrated value from the sample hold section 10, the average value from the averaging section 11, and the count value from the counting section 14 are input to the CPU 3.

The CPU 3 determines the level of contamination of air on the basis of the count value in the same way as in the first embodiment. More specifically, when the count value exceeds level 1, this is determined to be an environmental abnormality level. When the count value exceeds level 2, this is determined to be a fire warning alarm level. On the other hand, the CPU 3 determines the level of the fire on the basis of the hold value or the average value. For example, when the hold value or the average value exceeds level 1, this is determined to be a pre-alarm level. When the hold value or the average value exceeds level 2, this is determined to be a fire level.

In this embodiment, the same advantages as in the above-described embodiment can be obtained. In addition, since the light emitting section 5 is intermittently driven in this embodiment, it is possible to save power.

In another embodiment in which the light emitting means emits continuous light or pulse light, a chopper (not shown) is used. More specifically, a chopper is disposed in the front side of the light emitting means. The chopper is driven by the pulse light/continuous light switching means in a condition in which the light emitting means is made to emit light continuously. With such an arrangement, it is possible to obtain an output the same as pulse light. When continuous light is output, the chopper may be stopped. In this case, the pulse light/continuous light switching section has a control function such that the chopper is driven or stopped.

The CPU 3 serving as a determining means, including the first embodiment, may be disposed in either a sensor, a relay or a receiver.

The third embodiment of the present invention will now be explained with reference to the accompanying drawings.

FIGS. 30 to 34 illustrate an embodiment of the present invention. Regarding the drawings for this embodiment, the same drawings as those used for the above-described embodiments are used when the contents of this embodiment are the same as those of the above-described embodiments.

Figure 30:
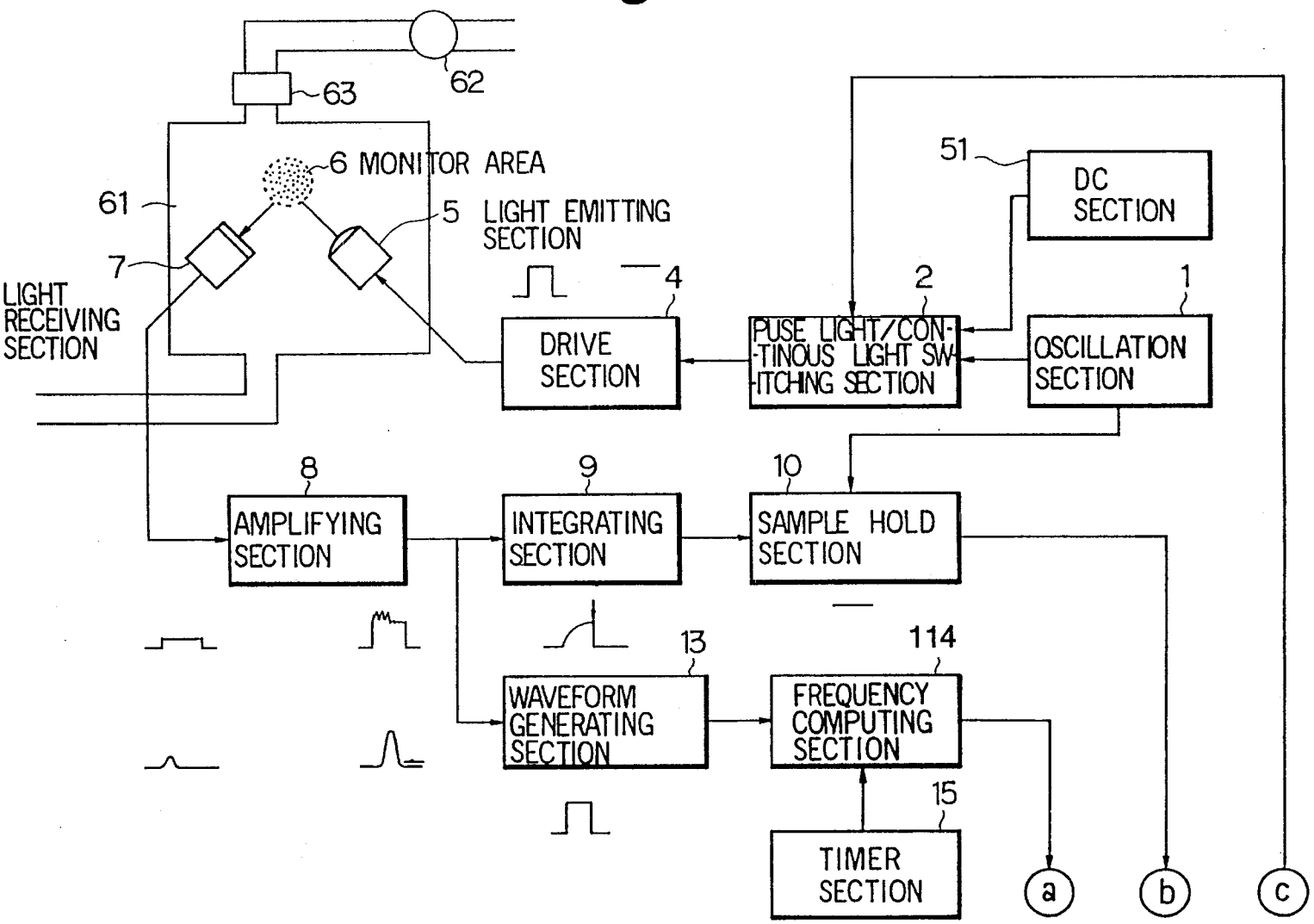
FIG. 30 is a block diagram illustrating the overall construction of a third embodiment of the present invention.
Figure 30B:
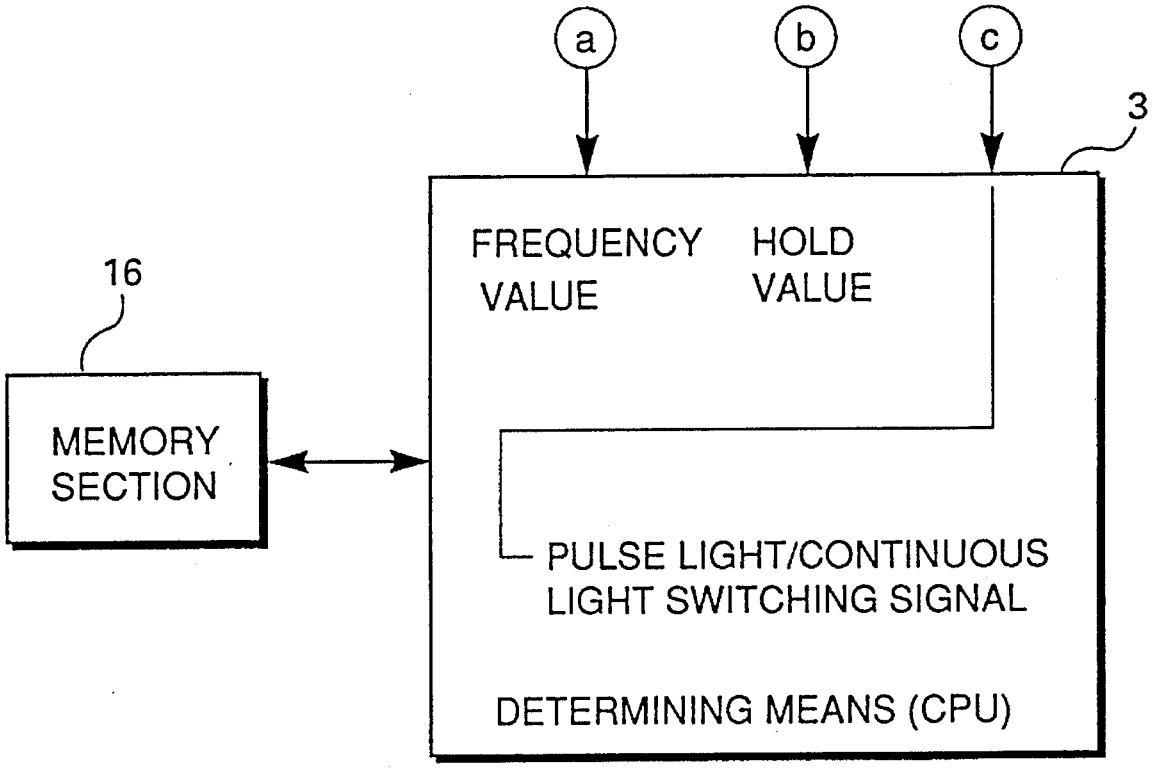

FIG. 30 is a block diagram illustrating the overall construction of the third embodiment of the present invention. the overall construction of the third embodiment is nearly the same as in FIG. 1, but a frequency computing section 114 serving as a frequency computing means is disposed. The frequency computing section 114 counts the frequency of waveform generated output levels for each level in a fixed period of time, output by the timer section 15, and computes the frequency distribution.

Reference numeral 16 denotes a memory section serving as a storing means, where the frequency distribution of the smoke particles output levels and the frequency distribution of the other fine particles output levels have been previously stored. Smoke particles and dust, and particles of fog will now be considered. Dust is created when solid substances break up and has a particle size of 1 to 100 μm. Fog is created when vapor is condensed and has a particle size of 5 to 50 μm. Smoke is created by combustion caused by a fire and has a particle size of 0.1 to 2.0 μm. Thus, smoke particles are smaller than those particles of vapor or the like.

Figure 31:
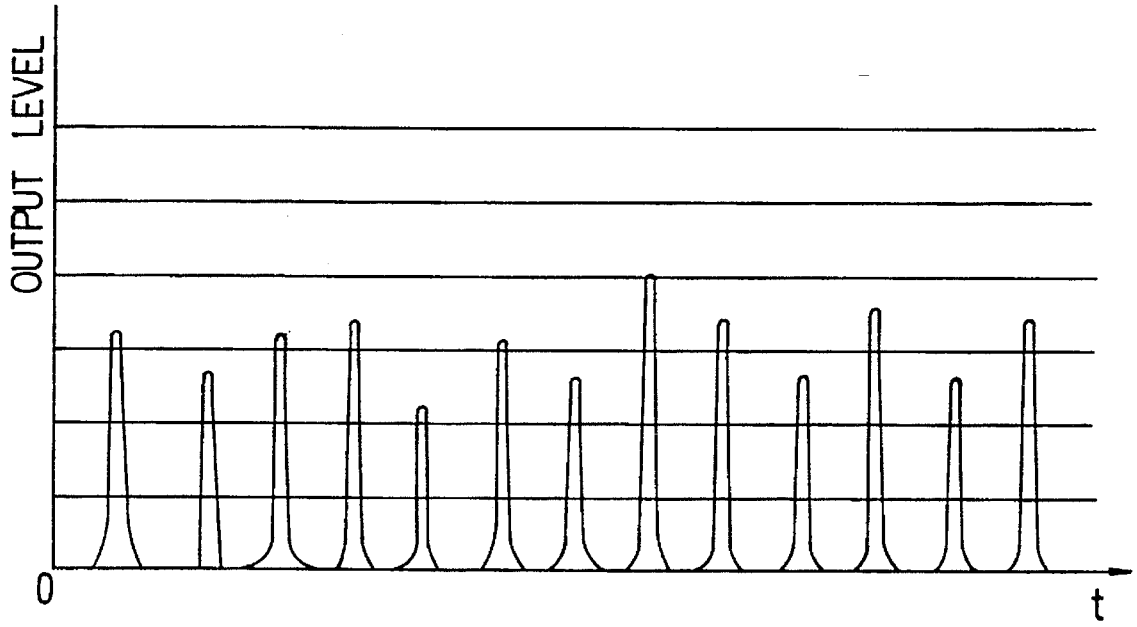
FIG. 31 is a graph illustrating the output level in the amplifying section in the case of dust and vapor.
Figure 32:
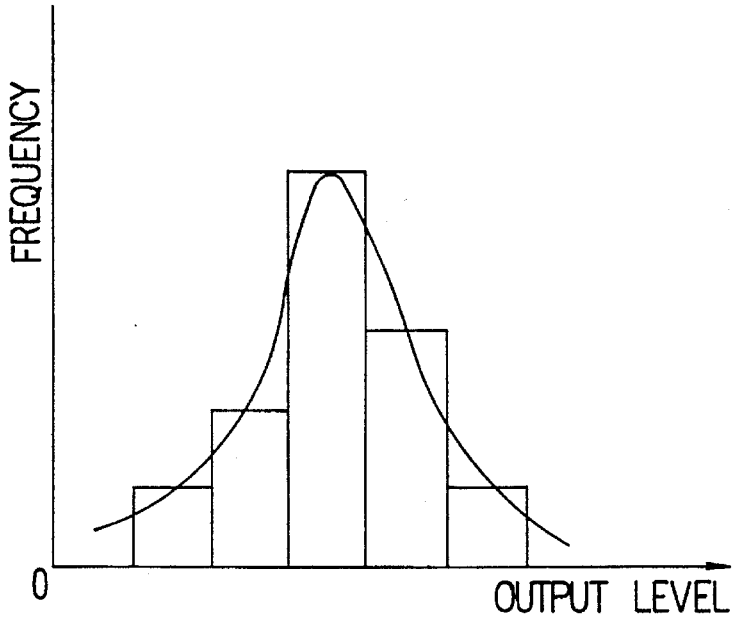
FIG. 32 is a graph illustrating the frequency distribution of the appearance of each output level within a fixed period of time in the case of dust.

The output level when dust, vapor or the like is detected is shown in FIG. 31. The distribution of the appearance frequency for each output level in a fixed period of time is plotted in FIG. 32. As is clear from FIGS. 31 and 32, particles such as dust or vapor are larger than smoke particles and show a nearly normalized distribution. The central value of the output levels becomes the maximum frequency (peak value).

Figure 33:
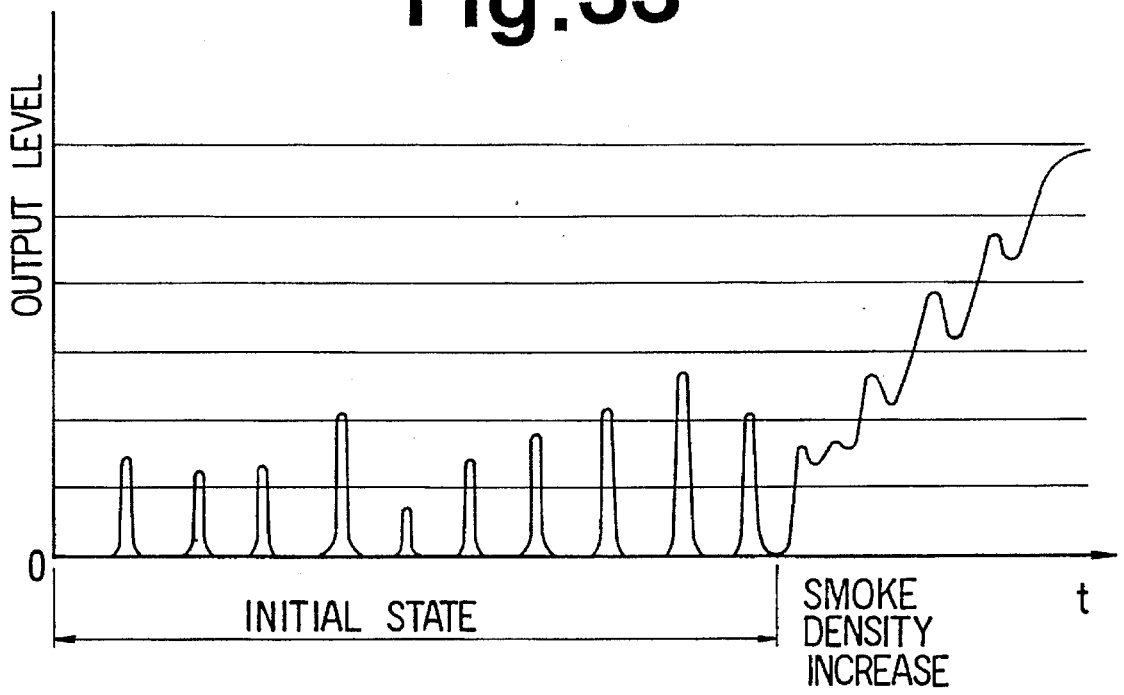
FIG. 33 is a graph illustrating the output level in the amplifying section in the case of smoke.
Figure 34:
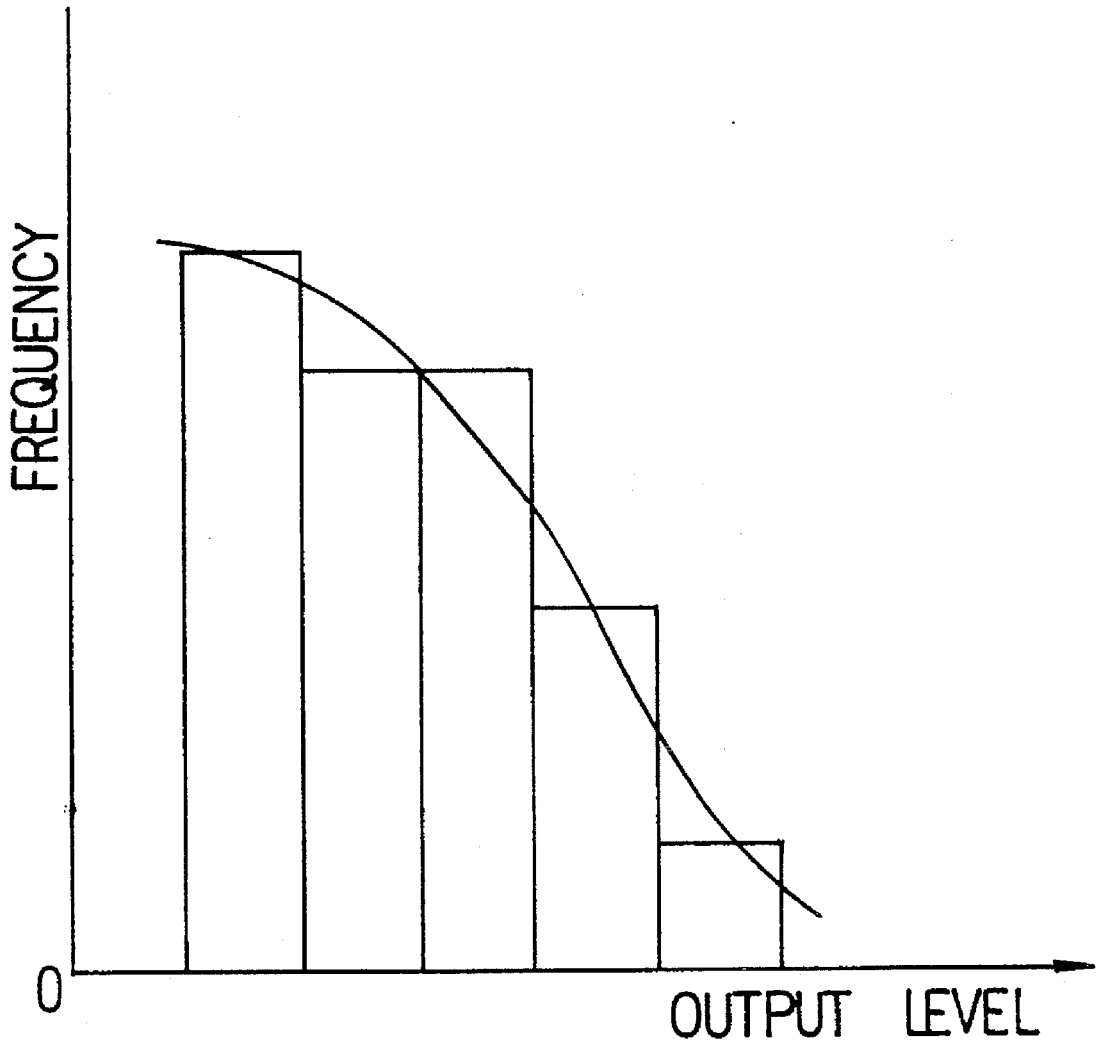
FIG. 34 is a graph illustrating the frequency distribution in the case of smoke.

Next, the output levels when smoke is detected are shown in FIG. 33. The distribution of the appearance frequency for each output level of smoke is shown in FIG. 34. As is clear from FIG. 34, the smoke frequency distribution in the initial state of a fire shows the maximum frequency (peak value) in the initial period of the output levels, and the frequency decreases as the output levels increase. Since smoke has a small particle size, it shows a rightward-descending frequency distribution, which is characteristic of smoke, in the initial stage of a fire. This frequency distribution is different from that of dust or vapor, as can be seen from FIGS. 32 and 34. The frequency distribution of the output levels of smoke and the frequency distribution of the output levels of the other particles such as dust have been previously stored in the memory section 16.

Reference numeral 3 denotes the above-described CPU, which compares the frequency distribution computed by the frequency counting section 14 with that of smoke and other fine particles, which have been stored previously, and the cpu functions as a determining means for distinguishing fine particles as smoke, dust or vapor. The CPU 3 also serves the function of determining the level of a fire on the basis of the hold value of the integrated value which is sample held by the sample hold section 10 or the average value of the received light output computed by the averaging section 11. When the CPU 3 determines that the fine particles are smoke, it issues a fire warning alarm. When the fine particles are determined to be dust or the like, the CPU issues an air contamination alarm.

The peak value of the appearance distribution of dust or vapor differs depending upon the environment where the detecting apparatus is arranged, and the distribution may be different from that shown in FIG. 4. In this case, the contents of the memory section 16 are changed appropriately, for example, a distribution pattern is measured and stored beforehand.

Next, an explanation will be given of the setting of the fire level on the basis of the hold value.

The relationship between the time when a fire occurs and smoke density is similar to that shown in FIG. 6. The smoke density increases in proportion to time in the same manner as that described earlier. However, since the smoke density is low and the volume of fine particles is small in the initial period of a fire, the integrated value calculated by the integrating section 9 is small in the same manner as in FIG. 7(B).

When the smoke density increases as time passes, as shown in FIG. 9, the integrated value calculated by the integrating section 9 increases sharply. When the integrated value exceeds, for example, level 1 of FIG. 9, this is determined to be a pre-alarm level; when the integrated value exceeds level 2, this is determined to be a fire level. If smoke is distinguished in the initial stage and thereafter the smoke density increases, the fire determination level may be lowered so that the above-described pre-alarm level becomes a fire level.

Figure 35:
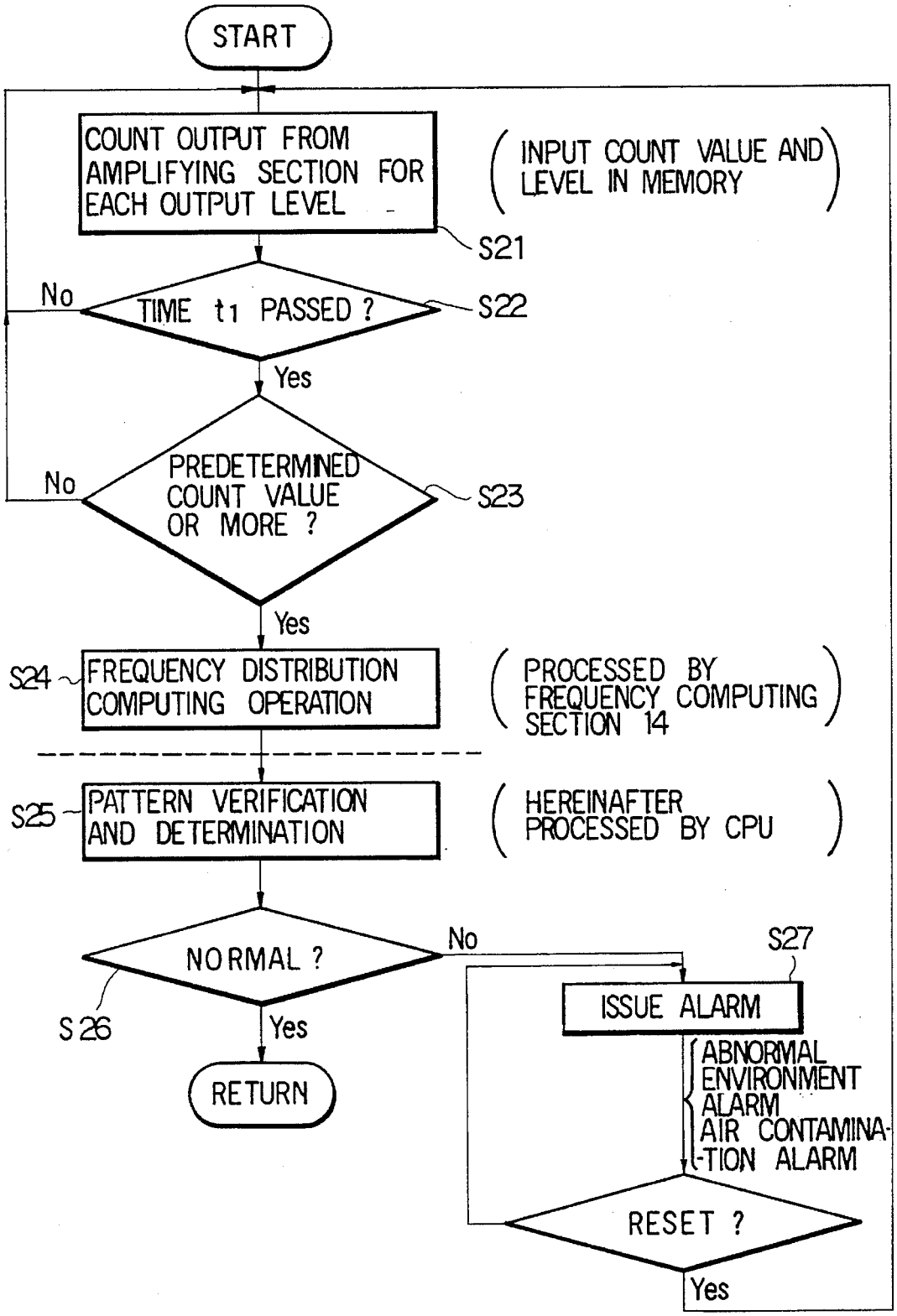
FIG. 35 is a flowchart illustrating the operation sequence of the third embodiment when the smoke density is low.
Figure 36:
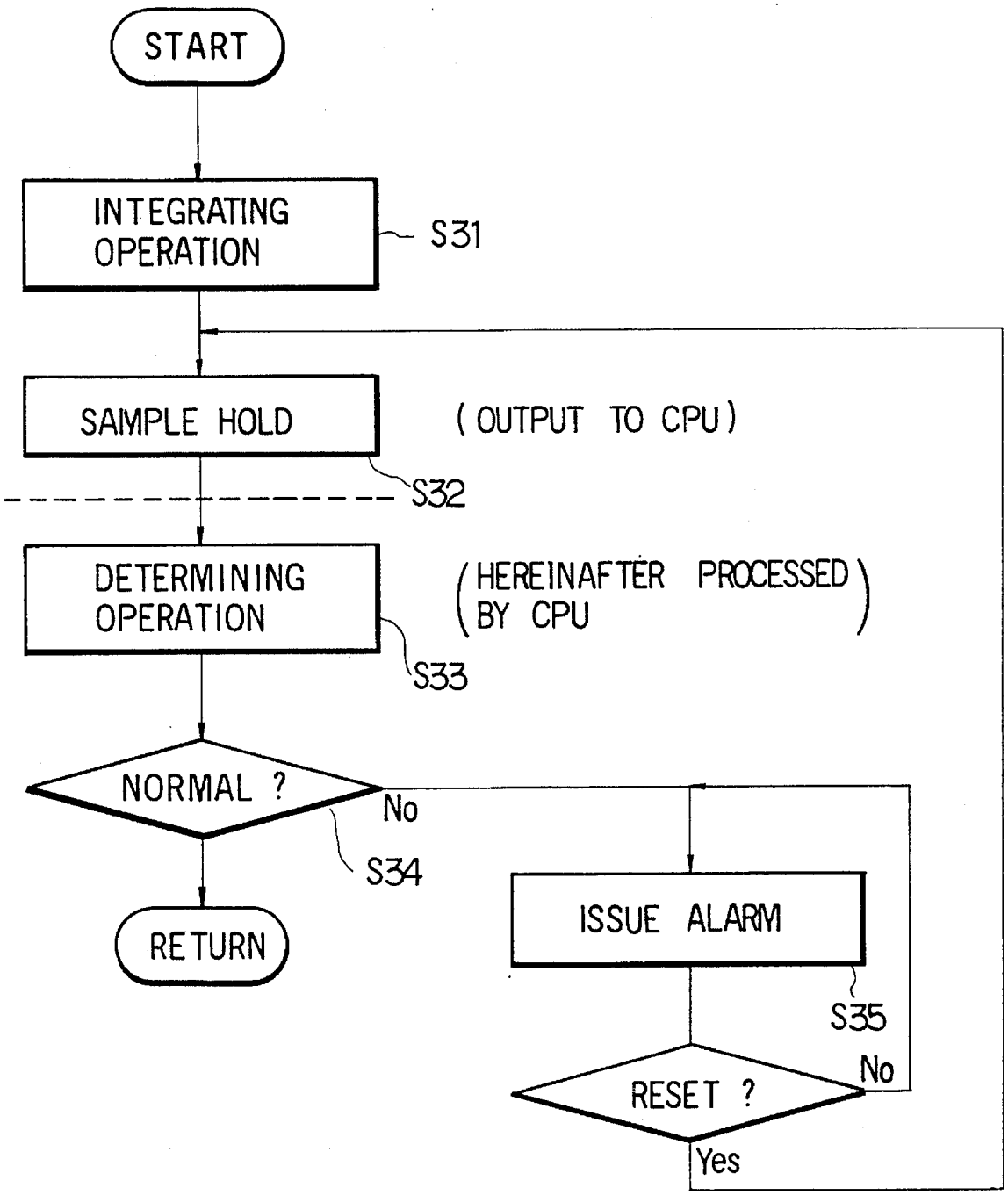
FIG. 36 is a flowchart illustrating the operation sequence of the third embodiment when the smoke density is high.

Next, the operation of this embodiment will be explained. FIGS. 35 and 36 are flowcharts illustrating the circumstance thereof.

A case in which the light emission of the light emitting section 5 is continuous light will be explained. The light emission of the light emitting section 5 is similar to that of FIG. 10. The output levels amplified by the amplifying section 8 are similar to that of FIG. 11.

The frequency computing section 14 counts the appearance frequency of the output levels amplified by the amplifying section 8 for each level (S21 to S23), computes the frequency distribution (S24), and outputs it to the CPU 3. The CPU 3 compares the frequency distribution from the frequency computing section 14 with each frequency distribution prestored in the memory section 16 (S25, S26). When the distribution is similar to the frequency distribution of FIG. 32, it is determined to be fire, and a fire warning alarm is issued (S27). When the distribution is similar to the frequency distribution of FIG. 34, it is determined to be dust, and an air contamination alarm is issued.

Next, when the smoke density increases thereafter, the received light output of the amplifying section 8 is as shown in FIG. 13, and the state in which the received light output of the amplifying section 8 is integrated by the integrating section 9 is as shown in FIG. 14 (S31). The peak of the integrated value computed by the integrating section 9 is sample held by the sample hold section 10 (S32). The hold value thereof is similar to that shown in FIG. 15. On the other hand, the average value is as shown in FIG. 16.

In this case, also, the CPU 3 determines the fire level on the basis of the hold value or the average value of the integrated value (S33, S34), and determines a pre-alarm level or a fire level (S34, S35). When the CPU 3 determines it is smoke in the initial stage of a fire, the fire level may be lowered so that the pre-alarm level becomes a fire level.

As described above, the particle size of vapor or dust is larger than that of smoke, and the frequency distribution with respect to the output levels becomes a nearly normal distribution. In the case of smoke, in contrast, since the particle size thereof is small, the frequency distribution with respect to the output levels forms a rightward-descending frequency distribution, characteristic of smoke. Therefore, it is possible to distinguish between smoke and dust of detected fine particles. More specifically, it is possible to issue an environmental abnormality alarm in the case of smoke, and to issue a contamination alarm in the case of dust, depending upon the level.

Next, as a fourth embodiment, a case in which the drive section 4 emits light intermittently will be described.

In FIG. 30, when the CPU 3 outputs a pulse-light/continuous-light switching signal indicating that pulse light be selected, to the pulse-light/continuous-light switching section 2, the light emitting section 5 projects pulse light corresponding to the oscillation frequency f0 onto the monitor area 6 in the same manner as in FIG. 23. The output levels of the amplifying section 8 when fine particles such as dust are present in the monitor area 6 are shown in FIG. 24. The frequency computing section 14 counts the output levels of the amplifying section 8, computes the frequency distribution, and outputs it to the CPU 3. The CPU 3 compares the computed frequency distribution with each prestored frequency distribution of smoke or the like prestored in the memory section 16 so as to distinguish smoke, dust or others. The received light output of the amplifying section 8 when smoke density increases thereafter is shown in FIG. 26. The received light output of the integrating section 9 is shown in FIG. 27, the hold value thereof in FIG. 28, and the average value thereof in FIG. 29.

The CPU 3 determines the level of the fire on the basis of the hold value or the average value. When, for example, the hold value or the average value exceeds level 1, this is determined to be a pre-alarm level. When it exceeds level 2, this is determined to be a fire level. Also, when it is determined to be smoke in the initial stage, the fire level may be lowered so that the pre-alarm level becomes a fire level. In addition, the frequency distribution data on smoke, dust or vapor, stored in the memory section 16, may be changed appropriately depending upon the environment where the detecting apparatus is disposed.

According to the present invention, as described above, it is possible to detect not only smoke but also fine particles such as dust by a single sensor, and only one optical system is required. Therefore, costs can be reduced considerably and reliability can be improved. In addition, it is possible to issue a fire warning alarm even at the initial stage of a fire when smoke density is low, making it possible to detect a fire more quickly.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the claims. The following claims are to be accorded the broadest interpretation, so as to encompass all such modifications and equivalent structures and functions.

What is claimed is:

1. A smoke detecting apparatus capable of detecting both smoke and fine particles in a monitoring area, comprising:

light emitting means for projecting a light beam onto said monitoring area;

light receiving means with an output located at a position where a light beam projected from said light emitting means is not directly received, said light receiving means receiving scattered light caused by fine particles including dust and smoke caused by fire entering said monitoring area;

amplifying means for amplifying said output from said light receiving means, said amplifying means having an output that may exceed a predetermined level a number of times;

counting means for counting the number of times that said output from said amplifying means has exceeded said predetermined level as a function of time for detecting said fine particles, said predetermined level being exceeded when fine particles are present in said monitoring area and said predetermined level being not exceeded when fine particles are not present in said monitoring area so that presence of fine particles is detected;

computing means for computing an average value of the output from said amplifying means as a function of time to detect said smoke; and determining means for determining a contamination level of said monitoring area dependent on a count counted by said counting means and determining characteristics of a fire as a function of said average value computed by said computing means when smoke density is high and the count counted by said counting means reaches a saturation point at which further counting cannot be carried out and emitting an alarm dependent on a result determined by said determining means.

2. A smoke detecting apparatus according to claim 1, wherein said light emitting means is formed of a halogen lamp.

3. A smoke detecting apparatus according to claim 1, comprising:

a pump for supplying air of the space to be monitored to said monitor area; and flow rate detecting means for detecting the flow rate of air in said monitor area.

4. A smoke detecting apparatus according to claim 3, wherein said flow rate detecting means is a flowmeter.

5. A smoke detecting apparatus according to claim 3, wherein said flow rate detecting means is a flow velocity meter.

6. A smoke detecting apparatus according to claim 3, wherein said flow-rate detecting means is a pressure gauge.

7. A smoke detecting apparatus according to claim 3, wherein said pump is controlled on the basis of a detected value of said flow rate detecting means so that the amount of air supplied to said monitor area is maintained to be a constant amount.

8. A smoke detecting apparatus according to claim 3, wherein said output of said light receiving means is updated on the basis of the value detected by said flow rate detecting means.

9. A smoke detecting apparatus according to claim 3, wherein said monitor area is cleaned at predetermined time intervals.

10. A smoke detecting apparatus according to claim 9, wherein said cleaning is performed by supplying clean air to the monitor area.

11. A smoke detecting apparatus according to claim 9, wherein, after said monitor area is cleaned, fine particles in the monitor area are detected.

12. A smoke detecting apparatus according to claim 1, wherein said parts comprise said light emitting means.

13. A smoke detecting apparatus according to claim 1 wherein when the amount of light emission of said light emitting means and light receiving sensitivity of said light receiving means is varied due to its deterioration or contamination, the amount of light emission of said light emitting means and light receiving sensitivity of said light receiving means is corrected.

14. A smoke detecting apparatus according to claim 1, wherein when the amount of light emission of said light emitting means and light receiving sensitivity of said light receiving means is varied due to its deterioration or contamination, an alarm is issued.

15. A smoke detecting apparatus according to claim 13, wherein a second light receiving means is disposed in the vicinity of said light emitting means so that when the amount of light received by the second light receiving means varies, an output of said light emitting means is corrected.

16. A smoke detecting apparatus according to claim 14, wherein a second light receiving means is disposed in the vicinity of said light emitting means so that when the amount of light received by the second light receiving means falls below a predetermined value, an alarm is issued.

17. A smoke detecting apparatus according to claim 14, wherein a second light receiving means is disposed in the vicinity of said light emitting means, a third light receiving means is disposed at a position where it faces said light emitting means and a light beam from said light emitting means directly enters said third light receiving means, so that the amount of light received by said second light receiving means is compared with the amount of light received by said third light receiving means and when the difference between them is a predetermined value or more, an alarm is issued.

18. A smoke detecting apparatus according to claim 13, wherein a second light receiving means,is disposed at a position where a light beam is directly projected onto said light receiving means, so that a test beam of a fixed amount is projected from said second light emitting means, so that the amount of the test beam is detected to correct the sensitivity of said light receiving means.

19. A smoke detecting apparatus as defined in claim 1, comprising:

drive means for driving said light emitting means; and light switching means for switching a signal input to said drive means so that light can be emitted from said light emitting means.

20. A smoke detecting apparatus as defined in claim 1, comprising:

a light chopper disposed on the front side of said light emitting means so that light is emitted from said light emitting means; drive means for driving said light emitting means; and light switching means for switching a signal input to said drive means.

21. A smoke detecting apparatus as defined in claim 1, including means for recording the time during which predetermined parts of said smoke detecting apparatus are operative and in use, and an alarm for indicating replacement of parts at predetermined time intervals.

22. A smoke detecting apparatus according to claim 13, including means for detecting a value of current consumption of said light emitting means and emitting an alarm when the current value falls below a predetermined value.

23. A smoke detecting apparatus according to claim 14, wherein a second light emitting means is disposed at a position where a light beam is projected directly onto said light receiving means, and a test beam of a fixed intensity is projected from said second light emitting means to said light receiving means, and means for issuing an alarm when the intensity of the test beam is a predetermined value or less.

24. A smoke detecting apparatus as defined in claim 1, wherein said predetermined value computed by said computing means is an average value.

25. A smoke detecting apparatus as defined in claim 1, wherein said predetermined value computed by said computing means is an integrated value.

26. A smoke detecting apparatus as defined in claim 1, wherein said light emitting means comprises a laser diode.

27. A smoke detecting apparatus as defined in claim 19, wherein said light comprises pulsed light.

28. A smoke detecting apparatus as defined in claim 19, wherein said light is continuous light.

29. A smoke detecting apparatus capable of detecting both smoke and fine particles in a monitoring area, comprising:

light emitting means for projecting a light beam onto said monitoring area;

light receiving means with an output located at a position where a light beam projected from said light emitting means is not directly received, said light receiving means receiving scattered light caused by fine particles including dust and smoke caused by fire entering said monitoring area;

amplifying means for amplifying said output from said light receiving means and having an output for each predetermined level corresponding to a diameter of said fine particles;

frequency computing means for differentiating the output from said amplifying means for each predetermined level corresponding to a diameter of said fine particles and counting as a function of time the predetermined levels from said output of said amplifying means over a fixed time period and computing a frequency distribution of said output of said amplifying means;

storing means for prestoring the frequency distribution of the output of said light receiving means for each of said levels when smoke particles enter said monitoring area and for prestoring the frequency distribution of all other particles corresponding to a diameter for each of said levels when other fine particles enter said monitoring area; and determining means for comparing the frequency distribution computed by said frequency computing means with that stored in said storing means and distinguishing between smoke and other fine particles, and emitting an alarm dependent on a result determined by said determining means.

30. A smoke detecting apparatus according to claim 29, wherein said determining means lowers a fire determination level when said determining means distinguishes smoke.

* * * * *